US008333026B2

(12) United States Patent
Southard

(10) Patent No.: US 8,333,026 B2
(45) Date of Patent: Dec. 18, 2012

(54) SYSTEM FOR HANGING MULTIPLE PICTURES IN A COLLAGE USING A GRID OF SUPPORTS

(75) Inventor: Jeff Southard, San Francisco, CA (US)

(73) Assignee: CollageWall, Inc., San Francisco, CA (US)

( * ) Notice: Subject to any disclaimer, the term of this patent is extended or adjusted under 35 U.S.C. 154(b) by 188 days.

(21) Appl. No.: 12/274,294

(22) Filed: Nov. 19, 2008

(65) Prior Publication Data

US 2009/0139127 A1 Jun. 4, 2009

Related U.S. Application Data

(60) Provisional application No. 61/004,688, filed on Nov. 29, 2007.

(51) Int. Cl.
*G09F 7/00* (2006.01)

(52) U.S. Cl. ..... 40/605; 40/745; 40/757

(58) Field of Classification Search ..... 40/605, 40/745, 757

See application file for complete search history.

(56) References Cited

U.S. PATENT DOCUMENTS 412,972 A 10/1889 Mitchell
3,371,439 A 3/1968 Smith et al.
3,471,959 A * 10/1969 Seger ..... 40/731
3,722,122 A 3/1973 Sesto
4,017,989 A * 4/1977 Murray ..... 40/731
4,123,862 A 11/1978 Dyer et al.
4,236,336 A 12/1980 Strom
4,237,631 A * 12/1980 Moe et al. ..... 40/783
4,340,144 A 7/1982 Cousins
4,497,125 A 2/1985 Hutchinson (Continued)

FOREIGN PATENT DOCUMENTS

JP 11-076021 3/1999

(Continued)

OTHER PUBLICATIONS

DIY Network, Photo Collage, Hanging, URL: http:www.diynet.com/diy/diy_kits/article/0,2019,DIY_13787_3400610,00.html, Sep. 29, 2008, 2 pages.

(Continued)

*Primary Examiner* — Gary Hoge
(74) *Attorney, Agent, or Firm* — Fliesler Meyer LLP

(57) ABSTRACT

A system for hanging multiple pictures, photographs, picture frames, or other objects, collectively referred to herein as pictures, in a collage, using a regularly-spaced grid of pegs or other supports that are attached to a wall. Each picture includes one or more sockets, generally along the top of the picture, or one or more of its edges, although in some embodiments a picture can include sockets located elsewhere on the picture. A picture can be attached to the grid by placing it on the grid so that its sockets are supported by the pegs. In accordance with an embodiment, to add a picture to the wall, a user places the top edge of the picture over the grid until its sockets fit around the pegs, and then allows the picture to swing into the wall until it rests against the wall or other supports. To remove the picture, the user gently lifts the picture off the pegs and removes it from the wall. This process can be repeated with multiple pictures to create or change a wall-mounted collage.

19 Claims, 27 Drawing Sheets

U.S. PATENT DOCUMENTS

| | | | | |
|---|---|---|---|---|
| 4,505,061 | A * | 3/1985 | Neuburger et al. | 40/489 |
| 4,542,051 | A | 9/1985 | Cirimele | |
| 4,549,713 | A | 10/1985 | Magadini | |
| 4,608,770 | A | 9/1986 | Gray | |
| 4,706,397 | A | 11/1987 | Hesener | |
| 4,777,067 | A | 10/1988 | Woronow | |
| 4,944,416 | A | 7/1990 | Petersen | |
| 5,172,504 | A | 12/1992 | De Matt | |
| 5,180,128 | A | 1/1993 | Massey | |
| 5,267,403 | A | 12/1993 | Hesener | |
| 5,425,524 | A | 6/1995 | Messina | |
| 5,444,929 | A | 8/1995 | Joseloff | |
| 5,484,067 | A | 1/1996 | Sothman | |
| 6,054,968 | A * | 4/2000 | De Matteo | 312/7.2 |
| 6,338,215 | B1 | 1/2002 | Vincent | |
| 6,618,955 | B2 | 9/2003 | Rice | |
| D498,595 | S | 11/2004 | Gordon | |
| 6,880,259 | B1 | 4/2005 | Schultz | |
| 6,945,414 | B1 | 9/2005 | Stevens | |
| 6,962,016 | B1 * | 11/2005 | Meyer | 40/757 |
| 7,086,190 | B2 | 8/2006 | Voluckas | |
| 2001/0034740 | A1 | 10/2001 | Kerne | |
| 2005/0193613 | A1 | 9/2005 | Faltesek | |
| 2005/0193614 | A1 * | 9/2005 | Conrad | 40/757 |
| 2005/0242047 | A1 | 11/2005 | Winig | |
| 2006/0181736 | A1 | 8/2006 | Quek | |
| 2006/0201039 | A1 | 9/2006 | Gilliland | |
| 2007/0044360 | A1 | 3/2007 | Hills | |
| 2007/0241071 | A1 | 10/2007 | Antonioni | |

FOREIGN PATENT DOCUMENTS

| | | |
|---|---|---|
| JP | 2000-276085 | 10/2000 |
| JP | 2003-325306 | 11/2003 |
| KR | 20-0188498 | 7/2000 |

OTHER PUBLICATIONS

Design Formula, Interior Design, Inspiration & Ideas, http://designformula.blogspot.com/2008/01/making-picture-wall-collage.html, Sep. 29, 2008, 14 pages.

The Perfect Picturewall Series 1000, Out of the Box and on Your Wall in Minutes, http://www.thepicturewallcompany.com/index.html, Sep. 29, 2009, 2 pages.

The Perfect Picturewall, Product, http://www.thepicturewallcompany.com/product.html, Sep. 29, 2009, 2 pages.

The Perfect Picturewall, What Is It!, http://www.thepicturewallcompany.com/whatisit.html, Sep. 29, 2009, 2 pages.

The Perfect Picturewall, How it Works, http://www.thepicturewallcompany.com/howitworks.html, Sep. 29, 2009, 2 pages.

The Perfect Picturewall, Endless Possibilities, http://www.thepicturewallcompany.com/endless.html, Sep. 29, 2009, 2 pages.

The Perfect Picturewall, What You Get, http://www.thepicturewallcompany.comwhatyouget.html, Sep. 29, 2009, 2 pages.

International Search Report and Written Opinion for PCT/U52008/085032, dated Jul. 16, 2009, 10 pages.

Photo wall by Jeremy Regenbogen; believed to have been created circa May 2008, per private communication with the inventor, 3 pages.

* cited by examiner

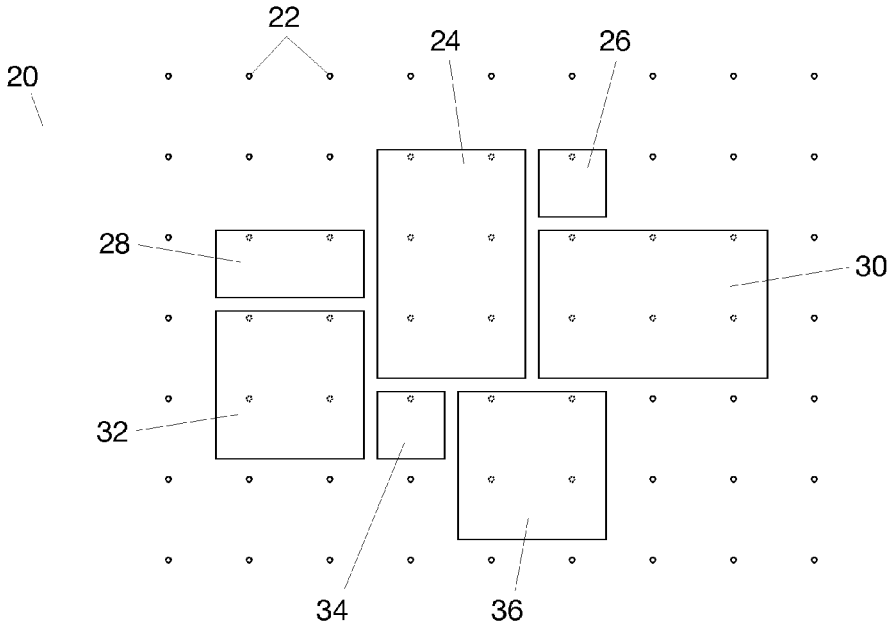
FIG. 1A
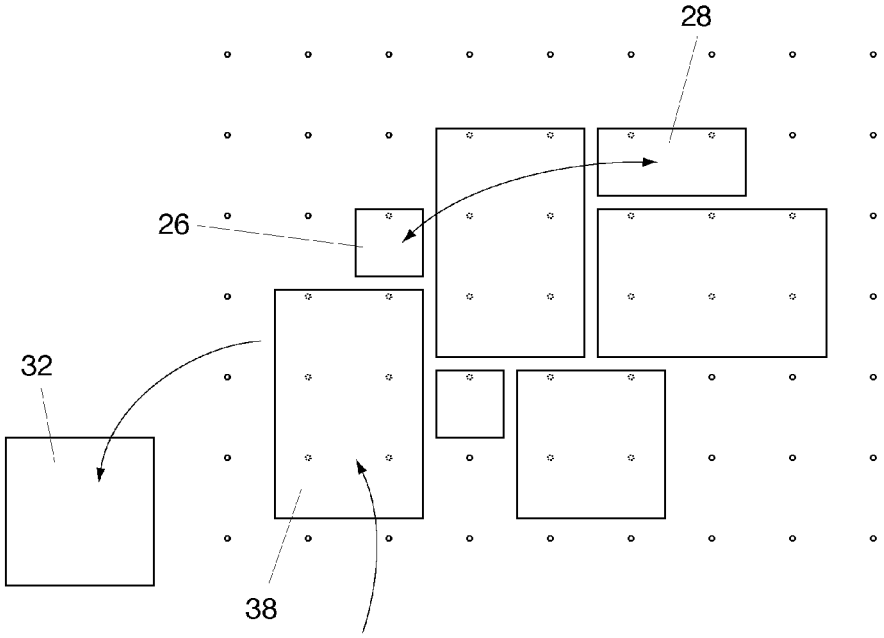
FIG. 1B
FIG. 1

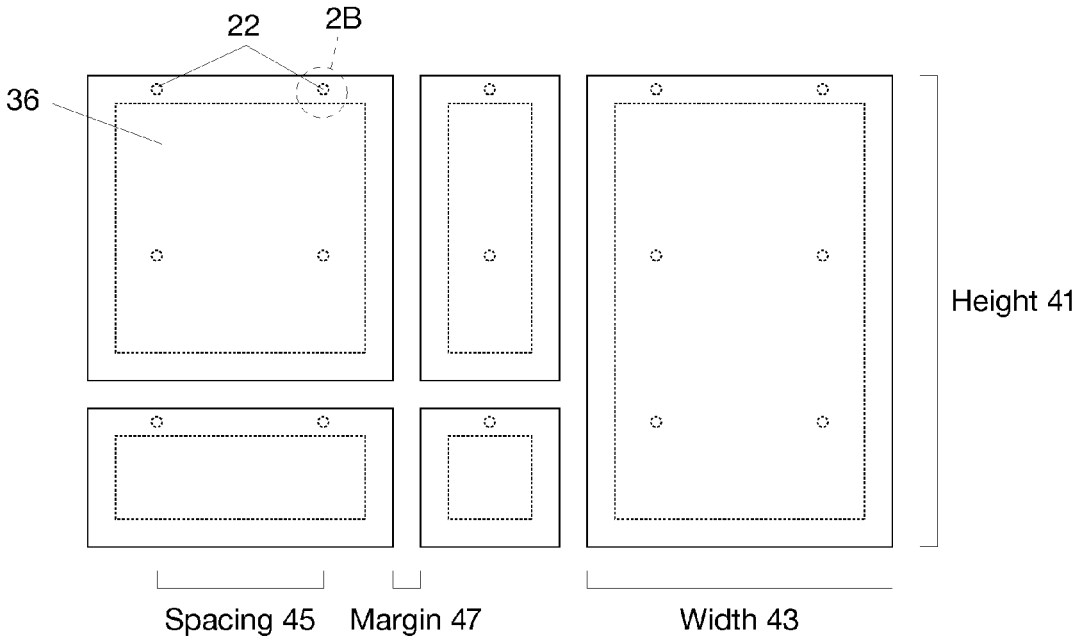
FIG. 2A
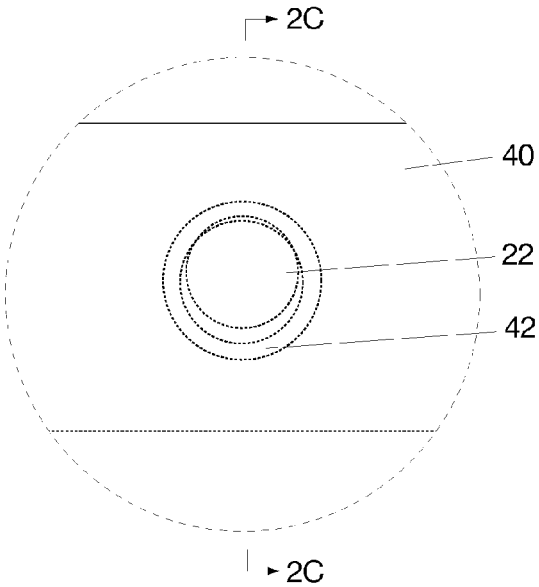
FIG. 2B
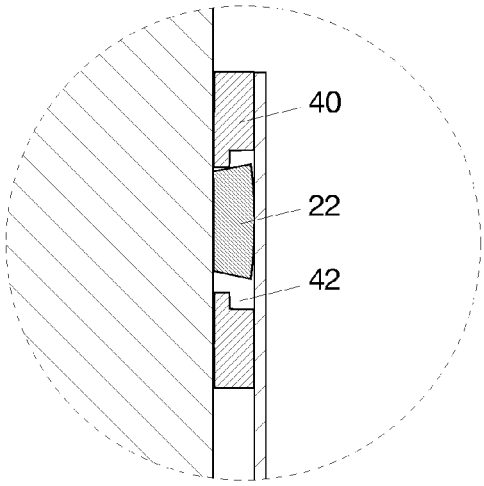
FIG. 2C
FIG. 2

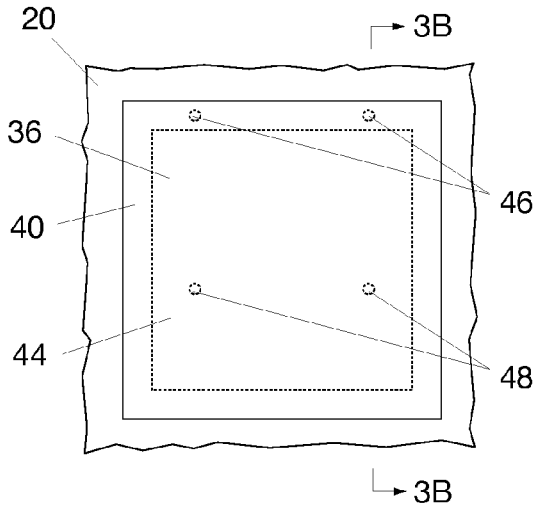
FIG. 3A
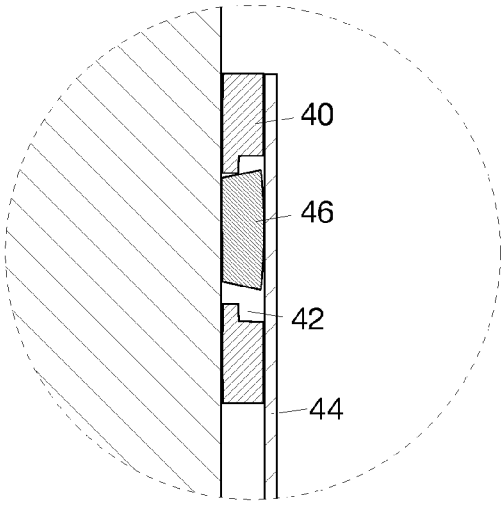
FIG. 3C
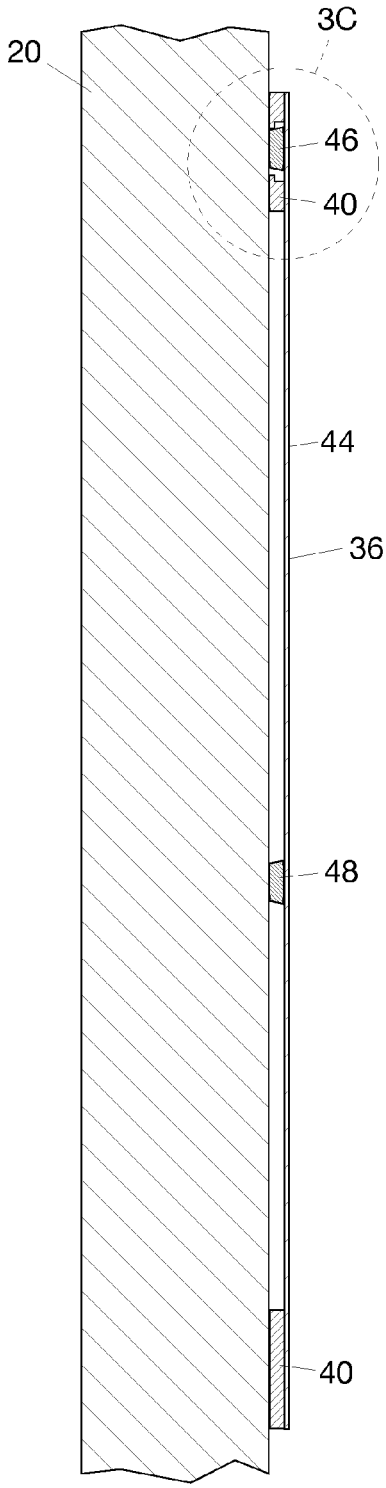
FIG. 3B
FIG. 3

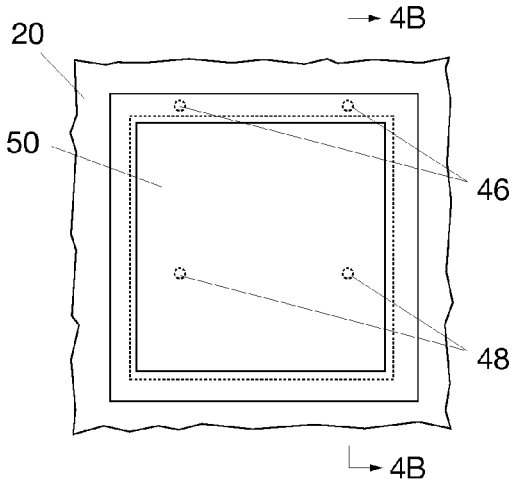
FIG. 4A
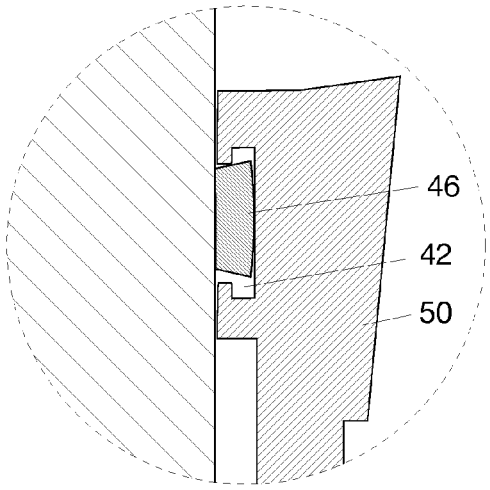
FIG. 4C
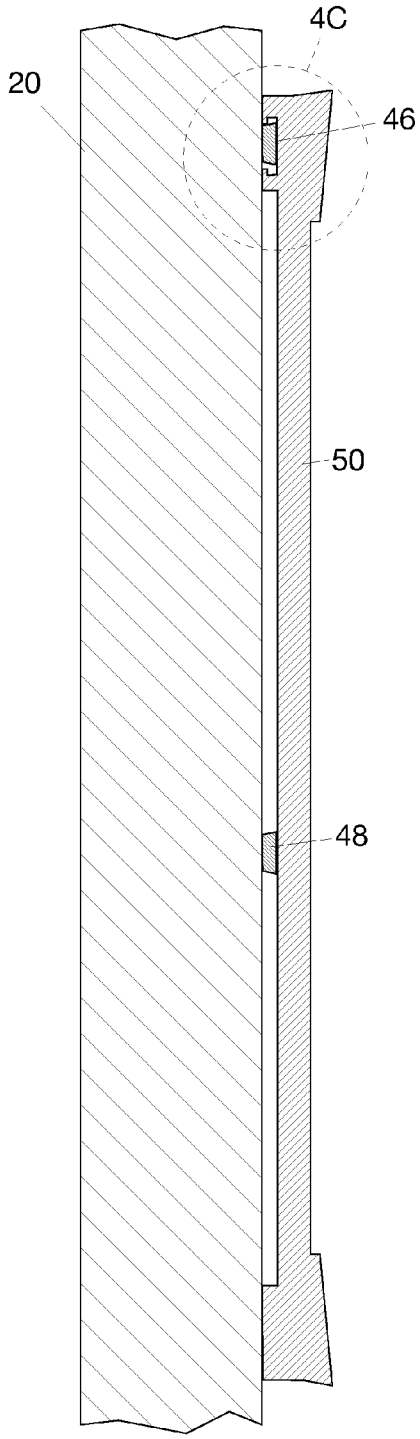
FIG. 4B
FIG. 4

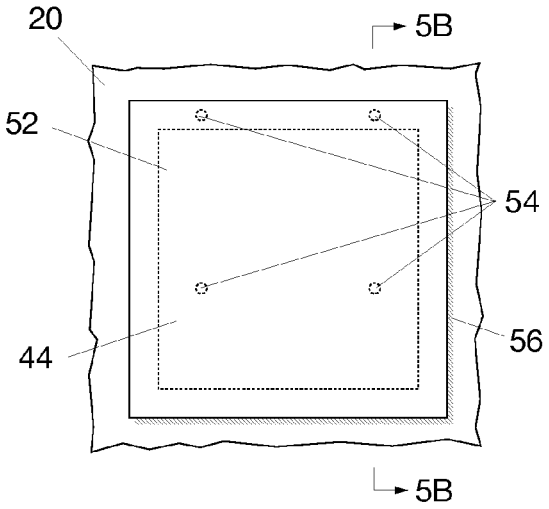
FIG. 5A
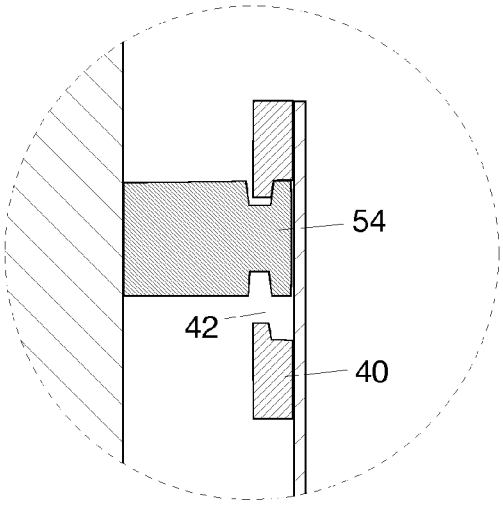
FIG. 5C
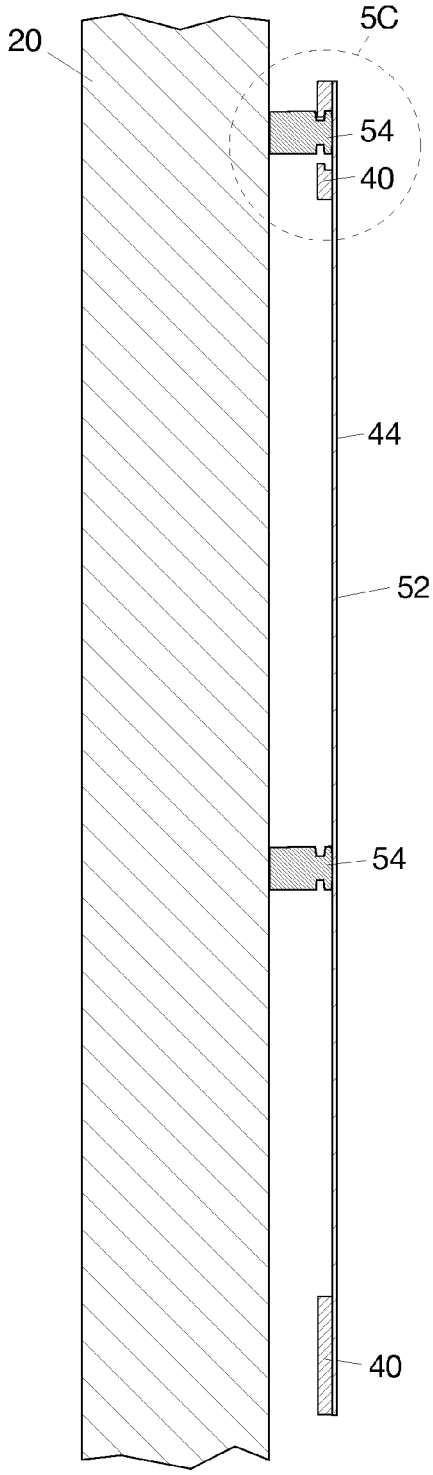
FIG. 5B
FIG. 5

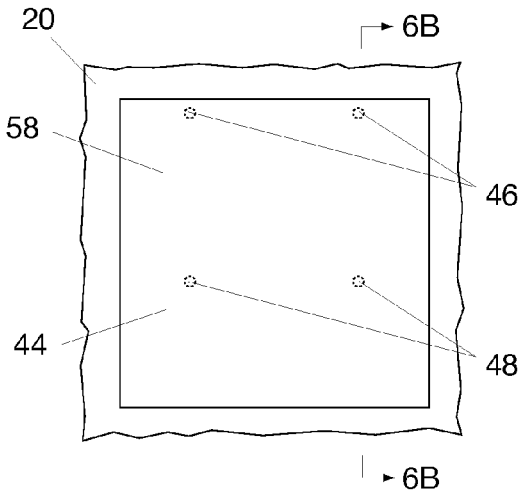
FIG. 6A
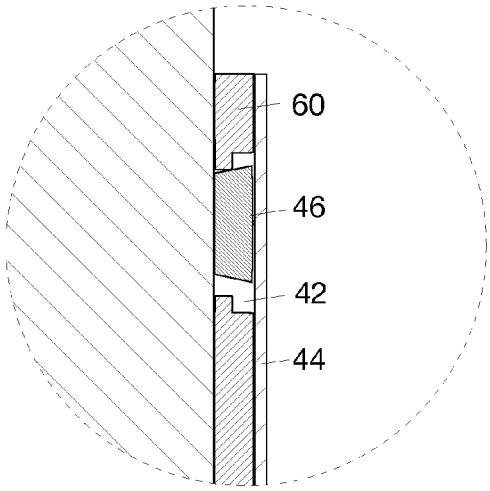
FIG. 6C
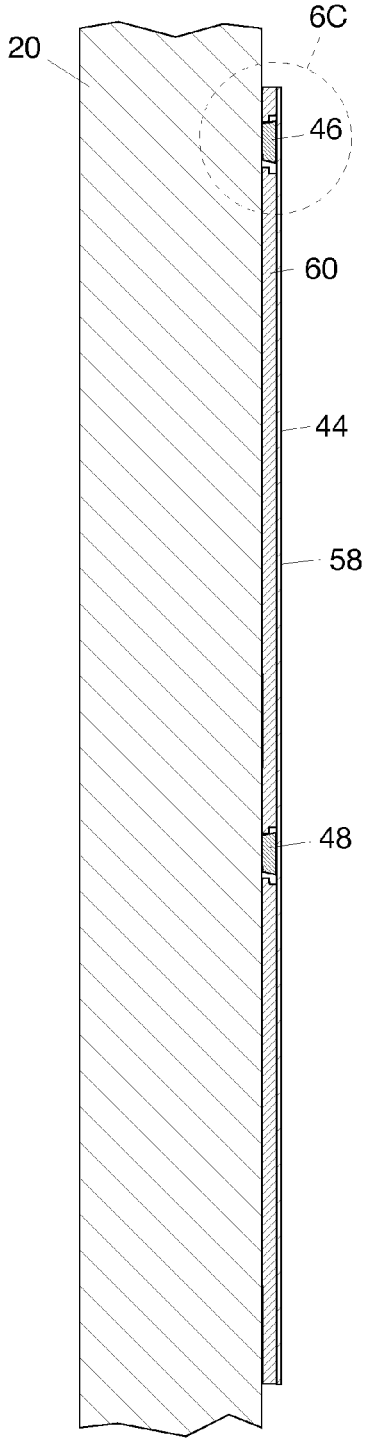
FIG. 6B
FIG. 6

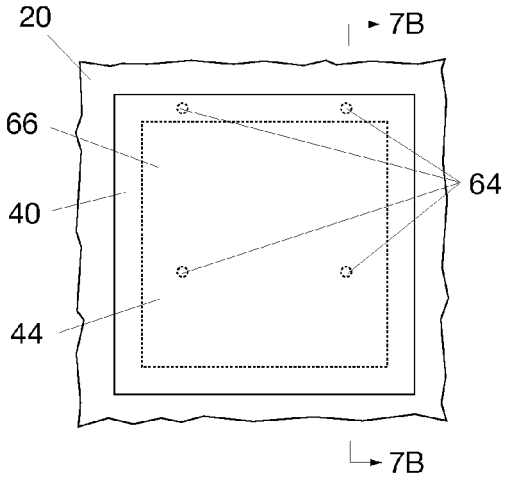
FIG. 7A
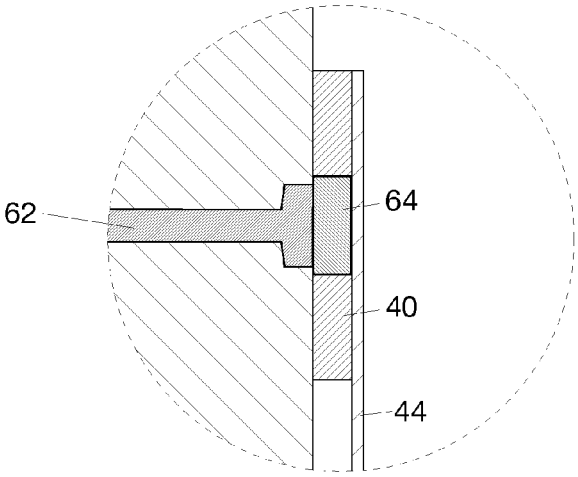
FIG. 7C
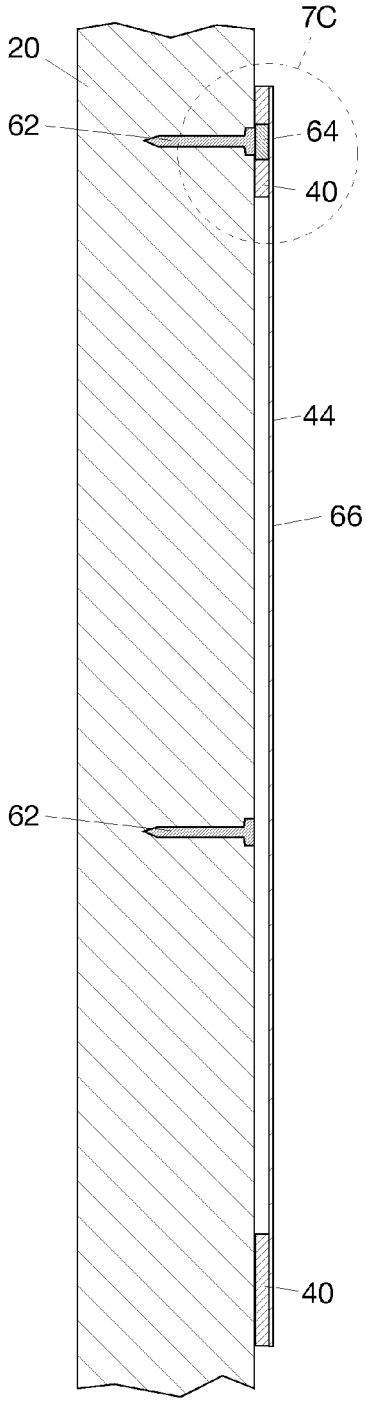
FIG. 7B
FIG. 7

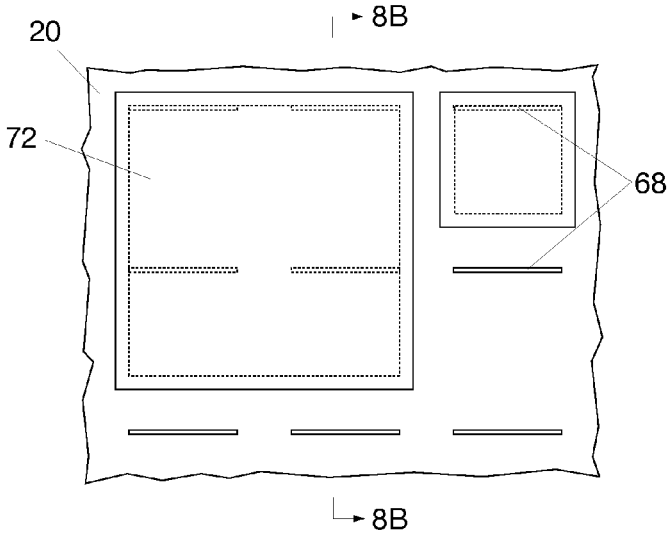
FIG. 8A
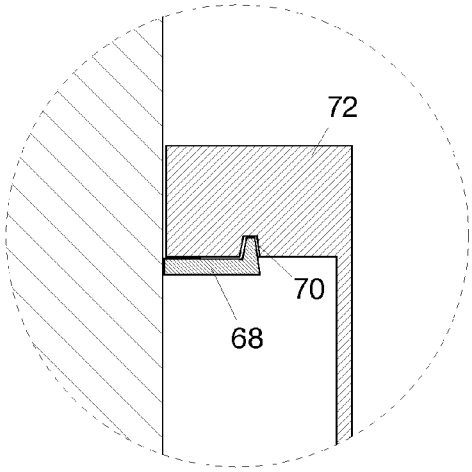
FIG. 8C
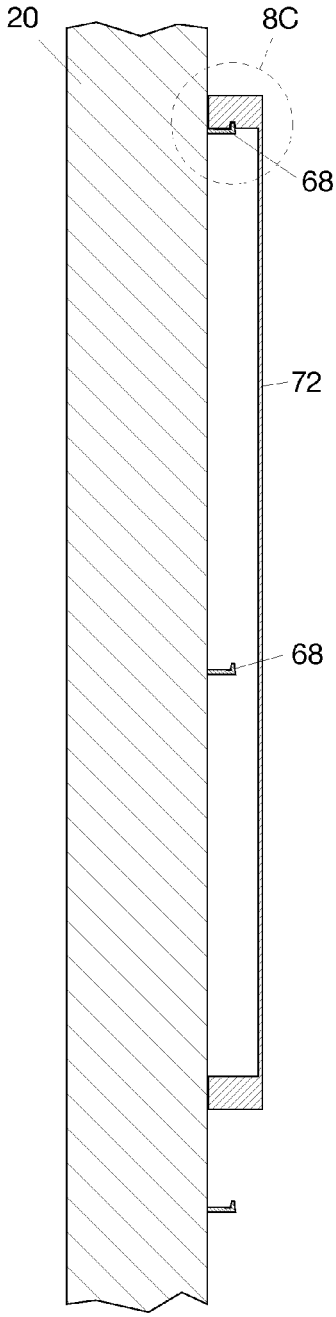
FIG. 8B
FIG. 8

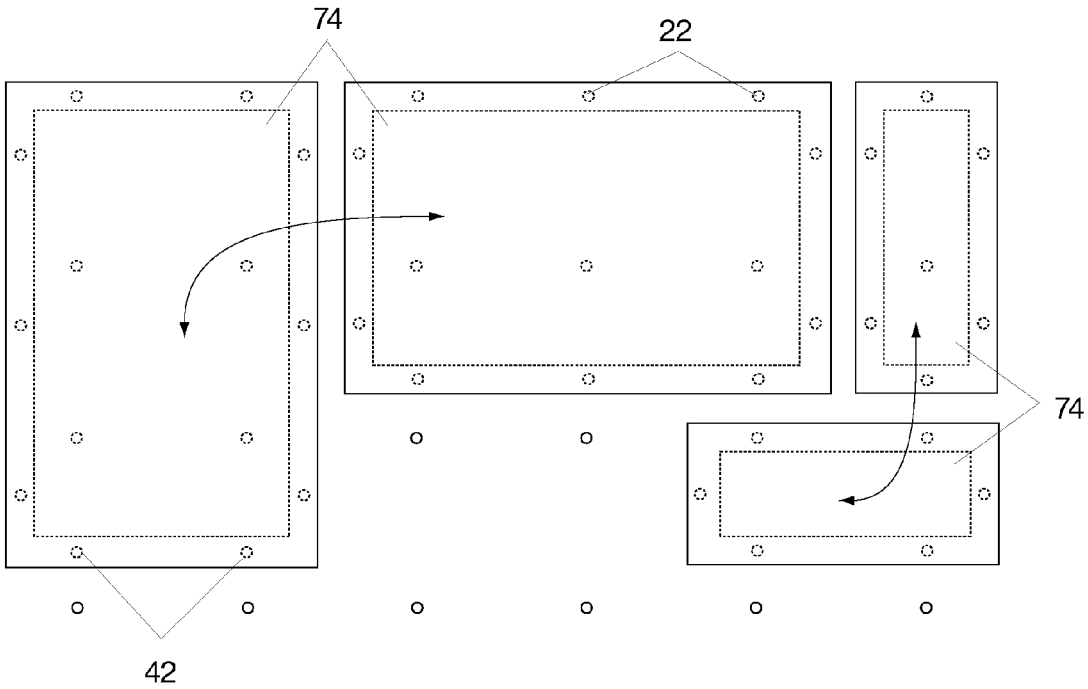
FIG. 9A
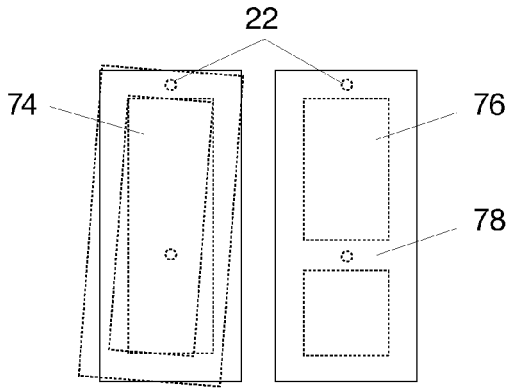
FIG. 9B
FIG. 9

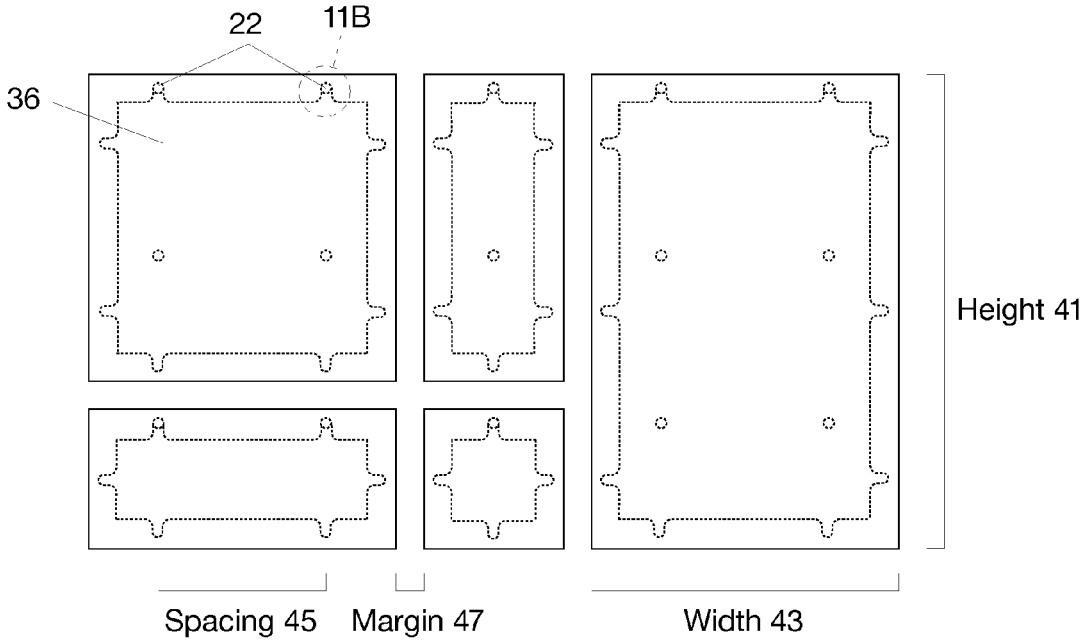
FIG. 11A
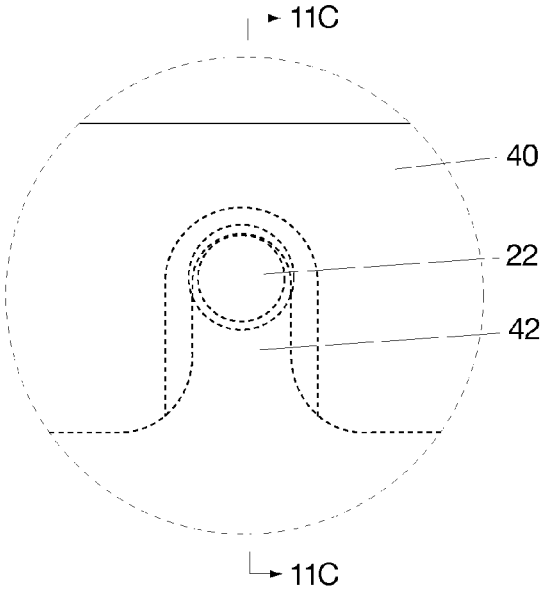
FIG. 11B
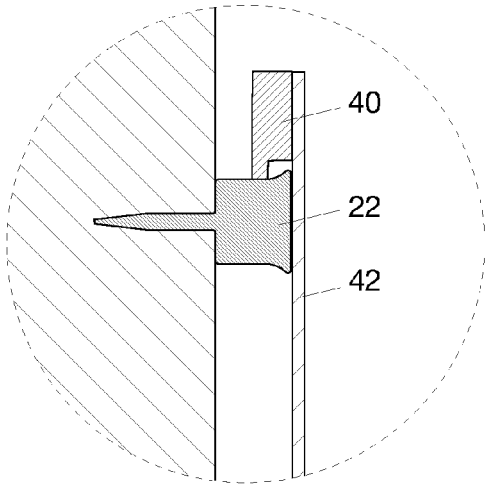
FIG. 11C
FIG. 11

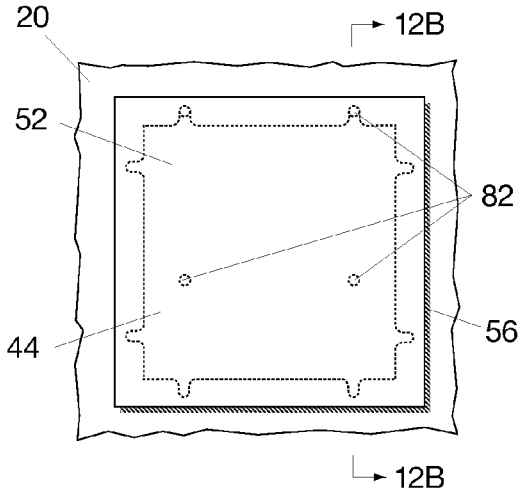
FIG. 12A
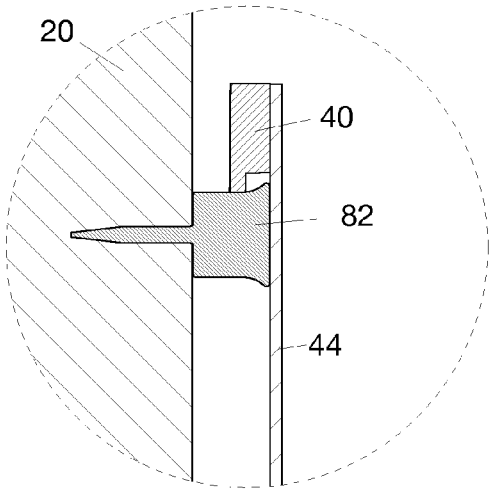
FIG. 12C
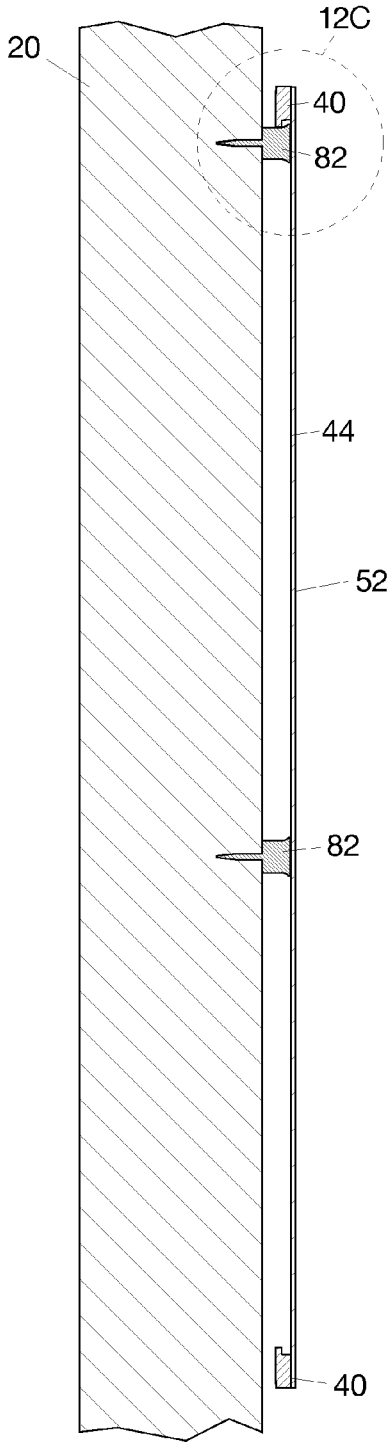
FIG. 12B
FIG. 12

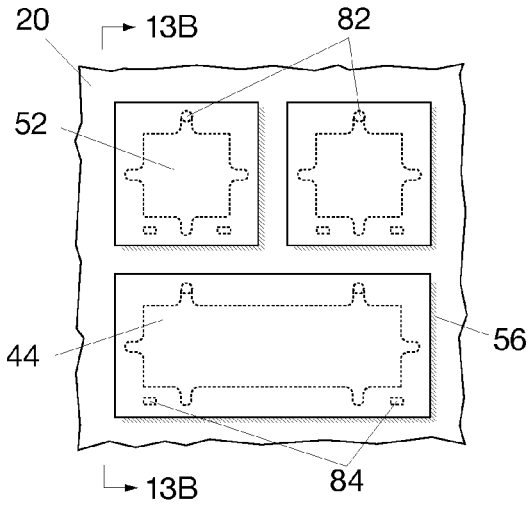
FIG. 13A
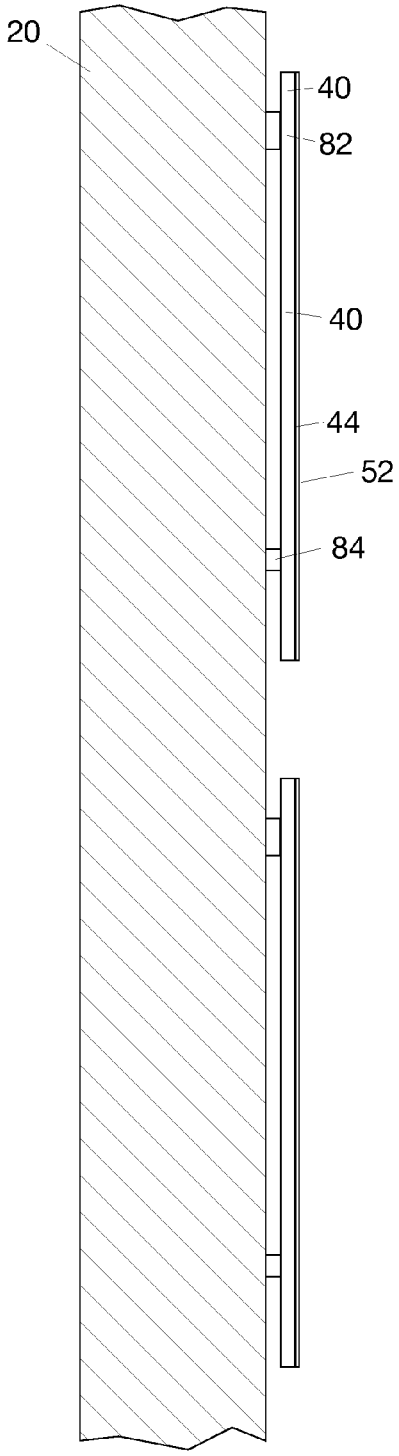
FIG. 13B
FIG. 13

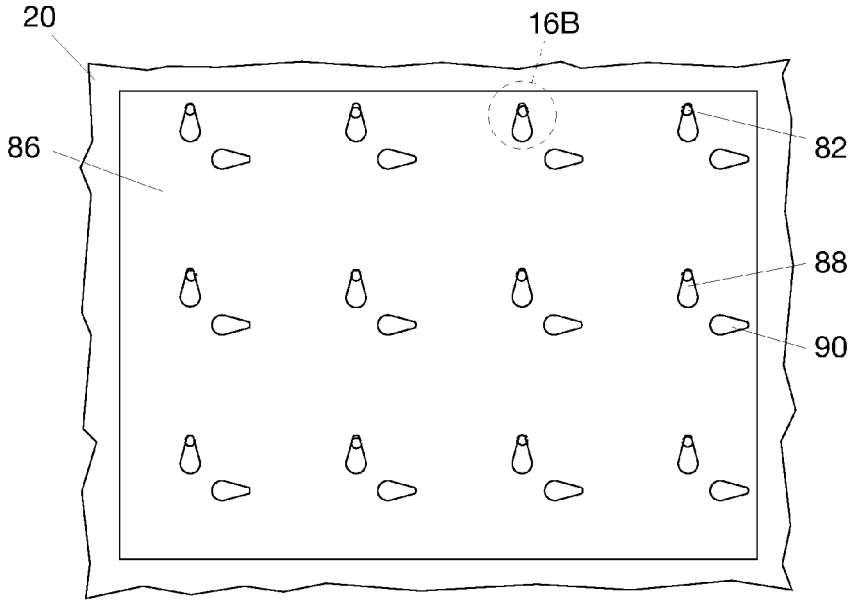
FIG. 16A
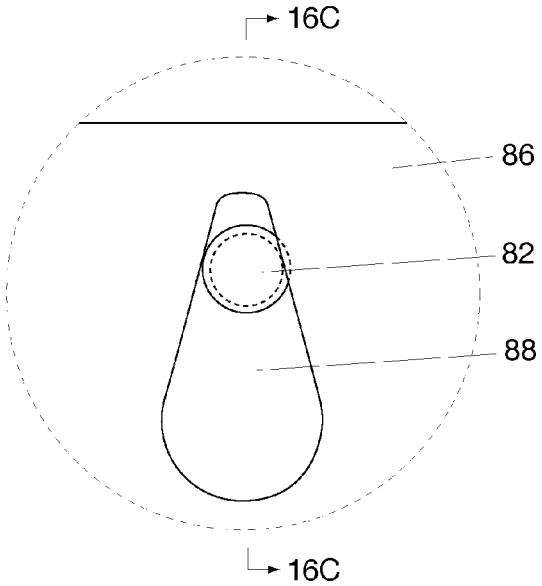
FIG. 16B
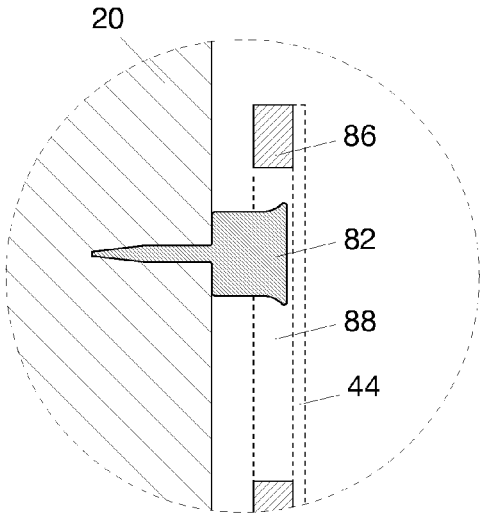
FIG. 16C
FIG. 16

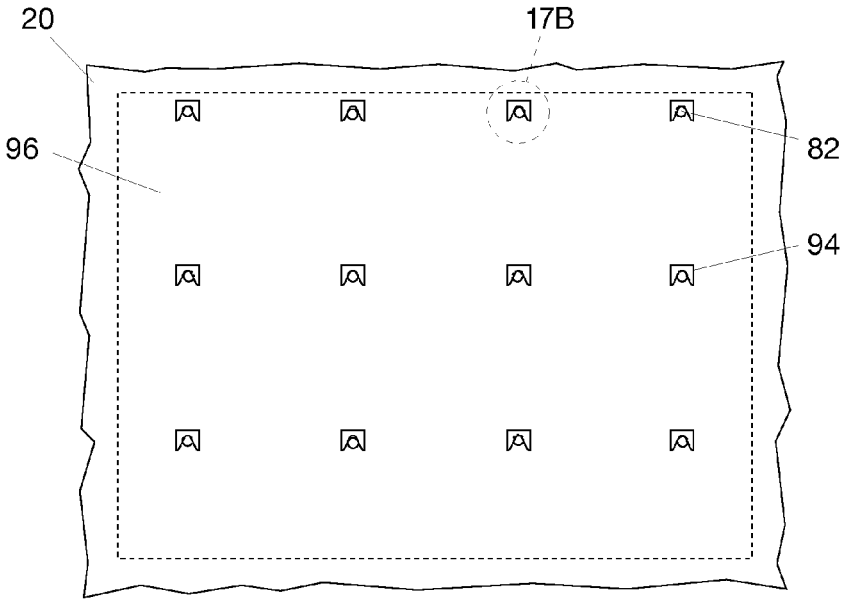
FIG. 17A
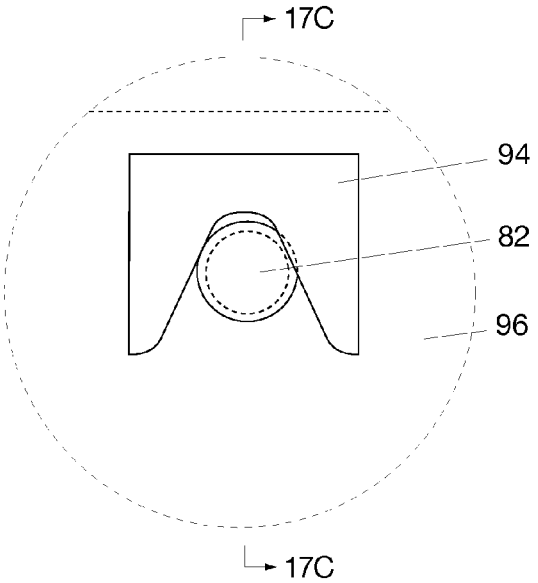
FIG. 17B
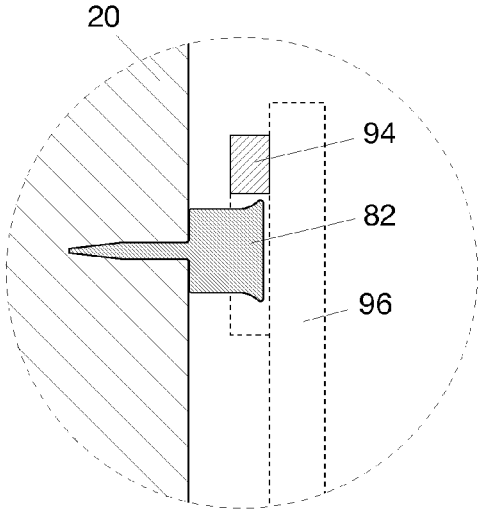
FIG. 17C
FIG. 17

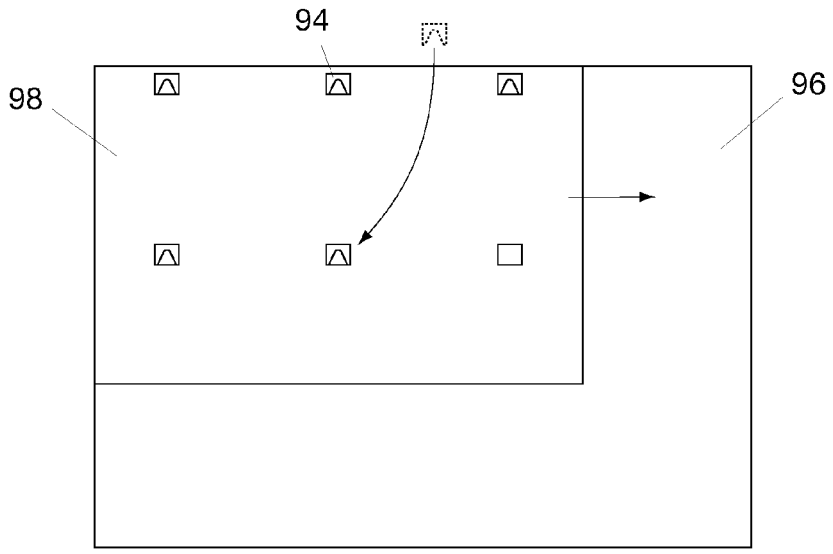
FIG. 18A
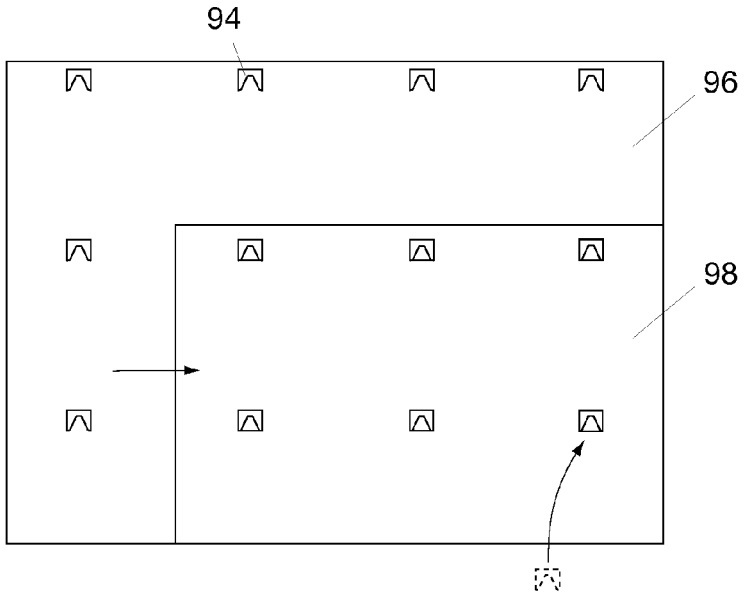
FIG. 18B
FIG. 18

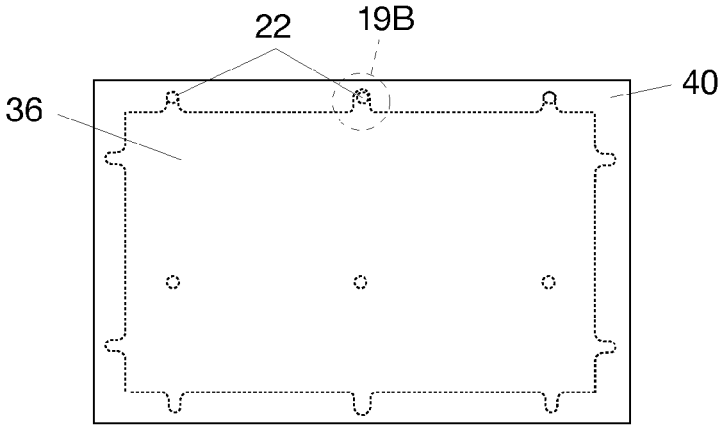
FIG. 19A
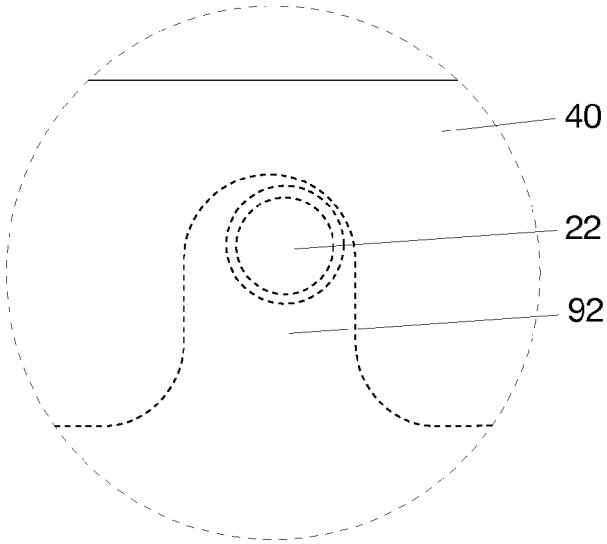
FIG. 19B
FIG. 19

SYSTEM FOR HANGING MULTIPLE PICTURES IN A COLLAGE USING A GRID OF SUPPORTS

CLAIM OF PRIORITY

This application claims the benefit of priority to U.S. Provisional Patent Application titled "SYSTEM FOR HANGING MULTIPLE PICTURES IN COLLAGE USING A GRID OF SUPPORTS"; Application No. 61/004,688; filed Nov. 29, 2007, and incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

The invention is generally related to a system for hanging multiple pictures, picture frames, or other objects within or as part of a collage, using a grid of pegs or other supports.

BACKGROUND

The use of collage is a centuries-old technique. Originally a work of visual art expressed in paper, collage is generally a juxtaposition of different component images, forms, or artwork to create an overall new whole. Some sources suggest that the introduction of paper-based collage dates as far back as the invention of paper itself. It is likely that most children and adults have at some point in their lives at least experimented with making their own collages.

At the same time, photography has grown to become one of the world's most currently popular pastimes. The ability to travel the world and instantly capture and preserve events as they occur has enthralled both professional and amateur photographers alike. Many homes have several personal cameras, which are used to record hundreds of photographs, capturing memories of those important, and sometimes less important, moments of everyday life. With the ability to digitally edit and enhance pictures, photography has become a common art medium in its own right.

The combination of collage and photography is a natural extension of these two art forms. A photographic collage can take the form of a photomontage, in which a number of images are overlaid upon one another in an artistic fashion; or it can take the form of a picture wall, in which individual pictures are grouped side-by-side in a pleasing pattern. A benefit to the picture wall approach is that each picture can be enjoyed either by itself, or within the context of all the other pictures. Generations of families have made such photo walls by simply hanging a group of photographs on a wall. Over time, with each new member of the family, or each new important milestone, that group may have grown, and the photographs within may have changed. Collectively, the photo wall is an expression of ones personal and family interests at any particular moment in time, coupled with a flavor of their artistic expression.

Some photographic collages are uniform in appearance, such as a nicely ordered arrangement of pictures on a wall. Other collages may be deliberately random, non-uniform, or jumbled in their arrangement of pictures. Regardless of the user's individual tastes, it is likely that they will want to change one or more of the pictures over the years, or even on a daily basis just to suit their mood. With most collages this is a time-consuming task. Pictures must be removed, remeasured and reinstalled. Often, new nail holes must be created to hang new pictures. Typically, a new picture will not perfectly match the position or spacing with each of the other pictures. Pictures of different sizes are almost impossible to integrate into an existing collage. The end result is often unsatisfactory, and somewhat unprofessional in appearance. Given these obstacles, once installed the typical collage is somewhat permanent, and users are unlikely to want to reconfigure it again.

Some systems attempt to allow for easier installation and reuse of collage members. For example, some systems provide for a template that can be attached to the wall and be used as a guide in installing pictures. However, these template designs are not easily modified to accept a non-standard picture. Template-based designs are also restricted in the types and arrangements of pictures that can be mixed-and-matched over the course of many years.

SUMMARY

Described herein is a system for hanging multiple pictures, photographs, picture frames, or other objects, collectively referred to herein as pictures, in a collage, using a regularly-spaced grid of pegs or other supports that are attached to a wall. In accordance with different embodiment, the pictures can include one or more of photos, stretched-canvas pictures, artwork, shadow boxes, whiteboards, chalkboards, mirrors, clocks, calendars, brochure holders, flat-screen computer displays, or other objects that a user may place within their collage. Each picture includes one or more sockets, generally along the top of the picture, or one or more of its edges, although in some embodiments a picture can include sockets located elsewhere on the picture. A picture can be attached to the grid by placing it on the grid so that its sockets are supported by the pegs. In accordance with an embodiment, to add a picture to the wall, a user places the top edge of the picture over the grid until its sockets fit around the pegs, and then allows the picture to swing into the wall until it rests against the wall or other supports. To remove the picture, the user gently lifts the picture off the pegs and removes it from the wall. This process can be repeated with multiple pictures to create or change a wall-mounted collage. Embodiments include features that allow for accurate alignment of the pictures in a horizontal and/or vertical manner, and for providing a precise collage layout including consistent margins between the plurality of pictures that comprise the collage.

BRIEF DESCRIPTION OF THE FIGURES

FIG. 1 is an illustration of a system for hanging multiple pictures in a collage in accordance with an embodiment.

FIG. 2 is another illustration of a system for hanging multiple pictures in a collage in accordance with an embodiment.

FIG. 3 is an illustration of a single picture in accordance with an embodiment.

FIG. 4 is an illustration of a picture with a traditional picture frame in accordance with an embodiment.

FIG. 5 is an illustration of a system for hanging multiple pictures in a collage, that uses long pegs in accordance with an embodiment.

FIG. 6 is an illustration of a system for hanging multiple pictures in a collage, that uses a solid backing in accordance with an embodiment.

FIG. 7 is an illustration of a system for hanging multiple pictures in a collage, that uses magnets and nails in accordance with an embodiment.

FIG. 8 is an illustration of a system for hanging multiple pictures in a collage, that uses rails in accordance with an embodiment.

FIG. 9 is another illustration of a system for hanging multiple pictures in a collage, in accordance with an embodiment.

FIG. 11 is an illustration of a system for hanging multiple pictures in a collage, that uses a modified peg and frame socket in accordance with an embodiment.

FIG. 12 is an illustration of a single picture that uses a modified peg and frame socket in accordance with an embodiment.

FIG. 13 is an illustration of various pictures or picture frames that are 1-unit high, and that includes spacers at the bottom.

FIG. 16 is an illustration of a rigid foam or other backing that can be used with a picture or picture frame, for mounting the picture or picture frame within a collage, in accordance with an embodiment.

FIG. 17 is an illustration of individual backing or stick-on sockets that can be used with a picture or picture frame for mounting within a collage, in accordance with an embodiment.

FIG. 18 is an illustration of a template that can be used to apply individual backing or stick-on sockets to a picture frame for mounting within a collage, in accordance with an embodiment.

FIG. 19 is an illustration of a picture or picture frame with multiple sockets and that further includes an oversized inner socket, in accordance with an embodiment.

DETAILED DESCRIPTION

Figure 10:
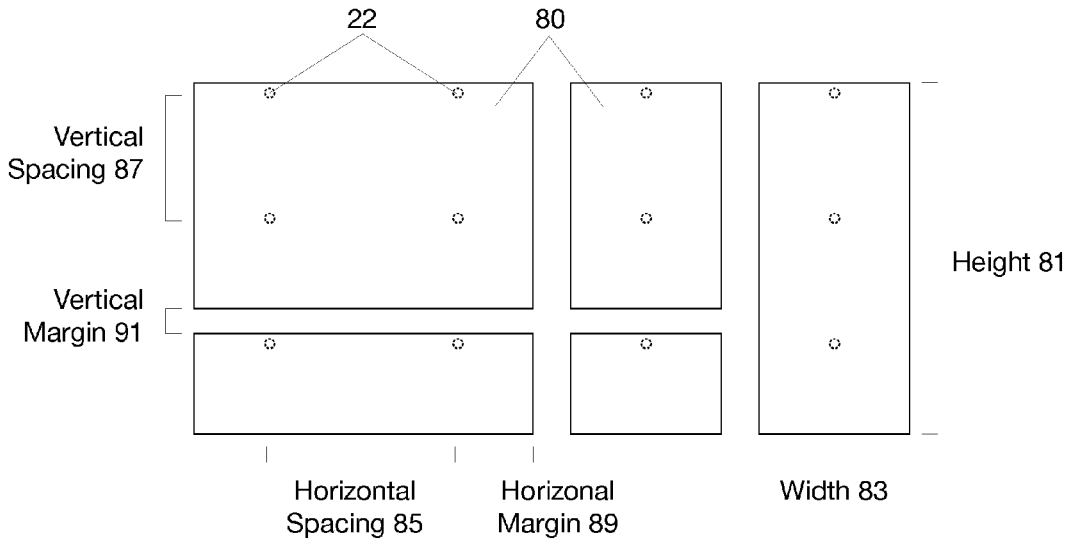
FIG. 10 is another illustration of a system for hanging multiple pictures in a collage, in accordance with an embodiment, which shows a front view of pictures on a non-square grid, together with a variety of different dimensions.

Described herein is a system for hanging multiple pictures, photographs, picture frames, or other objects, collectively referred to herein as pictures, in a collage, using a regularly-spaced grid of pegs or other supports that are attached to a wall. In accordance with different embodiment, the pictures can include one or more of photos, stretched-canvas pictures, artwork, shadow boxes, whiteboards, chalkboards, mirrors, clocks, calendars, brochure holders, flat-screen computer displays, or other objects that a user may place within their collage. Each picture includes one or more sockets, generally along the top of the picture, or one or more of its edges, although in some embodiments a picture can include sockets located elsewhere on the picture. A picture can be attached to the grid by placing it on the grid so that its sockets are supported by the pegs. In accordance with an embodiment, to add a picture to the wall, a user places the top edge of the picture over the grid until its sockets fit around the pegs, and then allows the picture to swing into the wall until it rests against the wall or other supports. To remove the picture, the user gently lifts the picture off the pegs and removes it from the wall. This process can be repeated with multiple pictures to create or change a wall-mounted collage. Embodiments include features that allow for accurate alignment of the pictures in a horizontal and/or vertical manner, and for providing a precise collage layout including consistent margins between the plurality of pictures that comprise the collage.

Some advantages of the system include that, when multiple supports and sockets are used for each picture, then the picture is constrained to remain level within the grid and on the wall. Mild wall vibrations over time that would tend to tilt standard picture frames have no effect on the pictures in the grid. Additionally, the regular spacing of the grid and the sockets on each picture and standard picture sizes ensures that a consistent margin is provided between each picture. Once the grid is installed, new pictures can be easily added to the collage, or rearranged within the collage, without any further measurement or guesswork as to where to place the picture, or whether the pictures will be properly located. If the collage and its pictures are removed, then the wall is still furnished with an aesthetically-pleasing grid of pegs. There are no stray nail holes from a haphazard arrangement of pictures. An empty grid can be immediately re-used for a new set of pictures, without having to begin the process of measurement, design, and installation anew. Similarly, if two grids have been installed in different locations but with the same criteria (i.e. the same peg type, and vertical and horizontal spacing between the pegs), then the pictures from a first grid can be easily moved to a second grid, without any further measurement, and yet still ensuring that those pictures can be installed as a collage having consistent margins.

The following reference numbers are used in the description of the various embodiments, figures, and examples provided herein, and are reproduced here for convenience:

| | |
|---|---|
| 20 | wall |
| 22 | support, peg |
| 24-38 | picture, picture frame, or object |
| 40 | back frame |
| 41 | valid picture height |
| 42 | socket |
| 43 | valid picture width |
| 44 | photographic print |
| 45 | universal c-to-c spacing |
| 46 | short peg along top edge of picture |
| 47 | universal margin |
| 48 | short peg in middle of picture |
| 50 | picture with traditional frame |
| 52 | picture offset from wall |
| 54 | long peg |
| 56 | shadow |
| 58 | picture with solid backing |
| 60 | solid backing |
| 62 | nail embedded in wall |
| 64 | magnet |
| 66 | picture supported by magnets |
| 68 | rail |
| 70 | groove in frame |
| 72 | stretched-canvas picture |
| 74 | non-square picture |
| 76 | picture with cross bar |

-continued

| | |
|---|---|
| 78 | cross bar with socket |
| 80 | picture based on a non-square grid |
| 81 | valid picture height |
| 82 | medium peg |
| 83 | valid picture width |
| 84 | spacer at bottom of back frame |
| 85 | horizontal c-to-c spacing |
| 86 | rigid foam backing |
| 87 | vertical c-to-c spacing |
| 88 | socket in rigid foam backing |
| 89 | horizontal margin |
| 90 | socket in alternate orientation |
| 91 | vertical margin |
| 92 | larger middle socket |
| 93 | stand element |
| 94 | stick-on socket |
| 96 | board (e.g. whiteboard, picture) |
| 98 | stick-on socket template |
| 102 | stairs |
| 110 | user interface |
| 112 | collage design |
| 114 | kit |
| 116 | real wall |
| 118 | real wall (changed) |

Grid and Support System

FIG. 1 is an illustration of a system for hanging multiple pictures in a collage in accordance with an embodiment, wherein FIG. 1A shows a front view of pictures on a grid in a collage layout, and FIG. 1B is the same view after rearranging the pictures. As shown in FIG. 1A, a plurality of supports 22, such as pegs, nails, screws, hooks, or other fasteners or supports, are first affixed to or inserted into the wall 20 in a regular, equally-spaced, pattern to form a grid. For convenience, each of these types of objects are referred to herein simply as pegs. The pegs can be made of any material that is suitable for hanging pictures, including for example, metal, brass, plastic, ceramic, or wood, and can have a plain, decorative, unobtrusive, or any other outward appearance.

Generally, the pegs are installed by a user in a square or rectangular fashion so that the pegs form horizontal rows and vertical columns of pegs on the wall. In the example illustrated in FIG. 1, a grid of 9 by 7 pegs is shown, although it will be apparent that any size and shape of grid can be created. It will also be apparent, as described in further detail below, that the grid can be installed in a rectangular or irregular shape (such as a triangle or parralelogram) to accommodate unusual wall spaces such as stairways or the fancy of the user. As described in further detail below, features such as templates and other tools can be provided to assist the user in the accurate installation of the pegs, regardless of the size and shape of the grid. As also described in further detail below, features can be provided to accommodate the pegs being placed slightly out of alignment within the grid.

Once the grid is installed, a plurality of pictures, picture frames, or other objects 24-36 can be attached to the grid to form a collage. As described above, for convenience, each of these types of objects are referred to herein simply as pictures. The pictures can be any item, for example photographs, stretched-canvas pictures, artwork, shadow boxes, whiteboards, chalkboards, mirrors, clocks, calendars, brochure holders, toys, plants, flat-screen computer displays, or any other object that a user would like to incorporate into a collage. In accordance with an embodiment, the pictures can include sockets, and can be attached to the pegs via the sockets, to make a collage. The pictures can be easily removed as desired to change the collage. For example, as shown in FIG. 1B, a square picture 32 can be removed, and replaced with a rectangular picture 38; or the positions of two different pictures 26, 28 can be interchanged.

To make a collage, the user can hang a picture in the middle of the grid, and then add pictures in positions adjacent to one another. The user can then rearrange the pictures until they are pleased with the appearance of the collage. At a later time, if the user obtains a new picture, the user can simply remove an old picture, and then add the new picture to the collage. In whichever arrangement the user chooses to hang the pictures, the pictures will be aligned in a precise layout with consistent margins, and no stray nail holes from the old picture arrangements. Friends and family with compatible grids (i.e. grids installed with the same criteria such as a similar peg type, and the same vertical and horizontal spacing between pegs) can share pictures by having one user give the picture to the other, who can then easily hang it on his or her own grid. To hang more pictures within the collage, the user can expand their grid by affixing more pegs past the top, bottom, left, or right sides of the existing grid.

In accordance with an embodiment, described in further detail below, a computer software can be provided to assist the user in designing a grid, and configuring it to display a collage. In accordance with an embodiment, the software includes a user interface that displays a representation of the grid, and allows the user to upload, display, move, and generally experiment with pictures on the grid, to create a virtual collage. When the user is satisfied with this computerized representation, they can configure their wall-mounted collage to match the virtual collage with the assurance that the wall-mounted version will match the computerized representation.

FIG. 2 is another illustration of a system for hanging multiple pictures in a collage in accordance with an embodiment, wherein FIG. 2A shows a front view of the pictures on a grid and illustrates a variety of different dimensions, while FIG. 2B is an enlarged front view of a peg and a socket, and FIG. 2C is an enlarged section view of the same. As shown in FIG. 2, a picture 36 can be suspended on the grid, by including a back frame 40 that includes one or more sockets 42 either along an edge of the picture, or on the reverse or back side of the picture. The sockets match the position and shape of the pegs 22 in the grid, i.e. they are spaced at a distance apart, and are shaped to fit around or on the pegs in the grid. In accordance with some embodiments, the back frame can be either attached to a picture, or alternatively can be manufactured or formed as part of the picture itself.

As further shown in FIG. 2, in accordance with an embodiment the pictures are made in particular dimensions that guarantee that, when the picture is placed on the grid in a collage with other pictures, each of the pictures will form a collage in which the edges of each picture align both horizontally and vertically, i.e. that there is a consistent margin between the pictures. This allows valid-sized pictures to be mixed-and-matched within a grid, and also allows pictures to be easily moved from a first grid to a second grid without the need to re-measure or re-install pegs or supports.

In accordance with an embodiment, the valid height 41 and valid width 43 values for a picture are dependent on the center-to-center spacing 45 between the pegs, and the desired margin 47 between the pictures, according to the formula:

$$\text{Valid Picture Width Values}=(N\times\text{Spacing})-\text{Margin}$$

$$\text{Valid Picture Height Values}=(N\times\text{Spacing})-\text{Margin}$$

Wherein in this embodiment the Spacing is the horizontal and vertical center-to-center spacing between the pegs (e.g. in inches) and is set by the user during the initial installation of the grid; the Margin is the desired margin between the pictures (e.g. in inches) and which can be selected by the user at any time but generally applies to all of the pictures in the current collage; and the value of N is any integer greater than zero. Table 1 provide some examples of the valid picture heights and widths for a variety of desired grid spacings and margins.

TABLE 1

| Horizontal and Vertical Grid Spacing | Horizontal and Vertical Picture Margin | Valid Picture Width Values and Height Values |
|---|---|---|
| 6" | 1" | 5", 11", 17", etc. |
| 6" | 2" | 4", 10", 16", etc. |
| 3" | 1" | 2", 5", 8", 11", etc. |

As described above, a picture can be used with any compatible grid spacing, including being moved from a first grid to a second grid, and still maintain the margin settings of the collage. Two grids share the same criteria if they use a similar peg type, and have the same vertical and horizontal spacing between the pegs. A picture and grid are compatible if the picture and the grid are based on the same Spacing and Margin values, and the pegs and sockets mechanically fit one another.

FIG. 3 is an illustration of a single picture in accordance with an embodiment, wherein FIG. 3A shows a front view of the picture on a grid, while FIG. 3B is a section view of same, and FIG. 3C is an enlarged section view of the top of the same. As shown in FIG. 3, in accordance with an embodiment, each picture 36 can comprise a back frame 40 on its reverse side, and a picture or photographic print 44 on its obverse or front side. Again, as described above, the back frame can be either attached to a picture, or alternatively can be manufactured or formed as part of the picture itself. In accordance with an embodiment the pegs 46 can be formed with bevelled edges or with a lip feature or other protrusion that better receives or holds sockets 42, and support the top edge of the back frame. Inner pegs 48, that are located within the boundary of the picture, are hidden behind the photographic print that then simply overlaps those pegs.

Alternatively, in accordance with an embodiment, the back frame can include voids as appropriate to accommodate the pegs. As a further alternative the back frame can include additional sockets that accept the pegs, and adhere the picture more securely to the grid. For example, FIG. 6, described in further detail below, illustrates an embodiment in which the picture or back frame includes multiple sockets both horizontally and vertically, that are spaced and shaped to fit pegs in the grid.

In accordance with an embodiment, to add a picture to the wall, the user grasps the picture with his or her fingers, and places the top edge of the picture or back frame over the pegs until its sockets fit around the pegs. The user then lets the picture swing into the wall until its bottom edge rests against the wall, or until the reverse of the picture or back frame rests against any inner pegs that may be within the boundary of the picture. This allows the picture to hang horizontally level, and substantially flush or parallel to the surface of the wall. To remove the picture from the wall, the user grasps the picture with his or her fingers and gently pulls it off the wall.

FIG. 4 is an illustration of a picture with a traditional picture frame in accordance with an embodiment, wherein FIG. 4A is a front view of the picture with the traditional frame on a grid, while FIG. 4B is a section view of the same, and FIG. 4C is an enlarged section view of the top of the same. As shown in FIG. 4, a picture with a traditional (e.g. wood, metal, plastic or other material) frame 50, or another substantially flat object, can hang on the grid, as long as the object has compatible sockets 42 that match the spacing and shape of the pegs. The object can include a back frame attached to a picture, or alternatively the back frame or sockets can be manufactured or formed as part of the object itself.

FIG. 5 is an illustration of a system for hanging multiple pictures in a collage, that uses long pegs in accordance with an embodiment, wherein FIG. 5A shows a front view of a picture on a grid with long pegs, while FIG. 5B is a section view of same, and FIG. 5C is an enlarged section view of the top of the same. When shorter pegs are used as described above, the picture hangs substantially flush or parallel to the wall 20. As shown in FIG. 5, when long pegs 54 are used, the same picture 52 hangs offset from the wall, which gives the collage more depth, and with proper lighting provides a dramatic appearance that some users prefer. Offsetting the collage from the wall also helps to compensate for minor imperfections in the wall surface. In accordance with an embodiment, each long peg can include a raised lip, groove and/or other protrusions or features that better fits into the sockets in the back frame or picture to receive or hold the socket. As similarly described above, the picture can rest against and/or hides any inner pegs 54. Under typical lighting, a soft shadow 56 will appear on the wall behind the collage, which can be increased or decrease for taste using comparatively longer or shorter pegs.

FIG. 6 is an illustration of a system for hanging multiple pictures in a collage, that uses a solid backing in accordance with an embodiment, wherein FIG. 6A shows a front view of a picture with a solid backing on a grid, while FIG. 6B is a section view of the same, and FIG. 6C is an enlarged section view of the top of the same. As shown in FIG. 6, in accordance with an embodiment each picture 58 can include a solid backing 60, which may be formed of any suitable material such as foam, wood, metal, or plastic. The backing 60 can include multiple sockets 42 distributed both horizontally and vertically over the backing, that are spaced and shaped to fit pegs 46, 48 in the grid. By being supported, or gripping not just the pegs 46 along a top edge of a picture, but also some or all of the pegs 48 at the middle or other edges of the picture, the picture 58 is held more securely to the grid. FIG. 16, described in detail below, illustrates another embodiment that utilizes this type of feature across the entire backing, and which is particularly suited for larger or heavier pictures.

FIG. 7 is an illustration of a system for hanging multiple pictures in a collage, that uses magnets and nails in accordance with an embodiment, wherein FIG. 7A shows a front view of a picture supported by magnets and nails embedded in a wall, while FIG. 7B is a section view of the same, and FIG. 7C is an enlarged section view of the top of the same. As shown in FIG. 7, the pegs can be made in the form of supports that are embedded within or hidden behind the surface of the wall. In accordance with an embodiment, steel flathead nails or similar supports 62 are used as pegs, wherein the supports are driven into the wall until flush with the surface of the wall. In accordance with this embodiment, each picture 66 includes one or more magnets in the place of sockets. The pictures can be supported on the grid as described above; however instead of hanging from pegs each picture is supported by the magnetic force between its magnet and the steel grid.

Alternatively, the magnet and its steel counterpart can be reversed, with the grid being composed of magnets embedded into the wall, and the pictures or other objects having metal components that are attracted to the grid. As another alternative, the grid, once embedded in the wall, can be painted over or otherwise masked, so that it is not readily visible when pictures are removed from the collage.

FIG. 8 is an illustration of a system for hanging multiple pictures in a collage, that uses support rails in accordance with an embodiment, wherein FIG. 8A shows a front view of a picture supported by rails, while FIG. 8B is a section view of the same, and FIG. 8C is an enlarged section view of the top of the same. In accordance with an embodiment the grid may be comprised of wide supports or rails 68 instead of pegs. These supports may reach as far as the margin between the pictures, so that when no pictures are placed on the grid the grid itself appears as a series of horizontal lines with breaks between the lines. The operation of the grid is as described above, with the difference that each picture 72 or back frame includes a groove 70 along an inside top edge, to allow the picture to sit upon or grasp a support rail.

FIG. 9 is another illustration of a system for hanging multiple pictures in a collage, in accordance with an embodiment, wherein FIG. 9A shows a front view of four rectangular pictures on a grid, and FIG. 9B is a front view of two rectangular pictures on a grid. As shown in FIG. 9, in accordance with an embodiment, each picture can include sockets along two or more edges, and in some instances along all edges. To rotate a picture from a taller to a wider orientation or vice versa, the user can remove the picture 74, rotates it 90 degrees, and place it back on the grid. Pictures 74 may have extra sockets 42 on one or more edges to allow mounting same pictures 74 in two orientations (i.e. tall or wide), or in any 90-degree rotation, or even upside-down.

FIG. 9B illustrates that, in some instances a tall picture 74 that is supported by just one peg could potentially be knocked out-of-level. To address this, in some embodiments a tall picture or its backing can include a backing cross bar 78 or other features across the middle of its reverse surface that includes a socket to allow the tall picture to receive another peg, and to hold the picture level, even if the collage is knocked. As with the frame material, the cross bar can be of various shapes and composed of various materials, including for example, wood, plastic, metal or wire.

FIG. 10 is another illustration of a system for hanging multiple pictures in a collage, in accordance with an embodiment, which shows a front view of pictures on a non-square grid, together with a variety of different dimensions. While each of the grid examples described above suggest the use of a square grid, in accordance with other embodiments a rectangular grid can be used instead, with the center-to-center spacing for the pegs in the horizontal direction being different from the center-to-center spacing for the pegs in the vertical direction. In such a rectangular grid, the valid height 81 and valid width 83 values for a picture are dependent on both the horizontal center-to-center spacing 85 and the vertical center-to-center 87 spacing between the pegs, and the desired horizontal margin 89 and vertical margin 91 between the pictures, according to the formula:

$$\text{Valid Picture Width Values}=(N\times\text{Horizontal Spacing})-\text{Horizontal Margin}$$

$$\text{Valid Picture Height Values}=(N\times\text{Vertical Spacing})-\text{Vertical Margin}$$

wherein the Horizontal Spacing is the horizontal center-to-center spacing between the pegs (e.g. in inches), the Vertical Spacing is the vertical center-to-center spacing between the pegs (e.g. in inches), both of which are set by the user during the initial installation of the grid; the Horizontal Margin and Vertical Margin are the desired horizontal and vertical margins respectively between the pictures (e.g. inches) which can be selected by the user at any time but which generally applies to all of the pictures in the current collage; and the value of N is any integer greater than zero. Table 2 provide some examples of valid picture heights and widths for a variety of desired grid spacings and margins.

TABLE 2

| Horizontal Grid Spacing | Horizontal Picture Margin | Valid Picture Width Values | Vertical Grid Spacing | Vertical Picture Margin | Valid Picture Height Values |
|---|---|---|---|---|---|
| 7.5" | 1.5" | 6", 13.5", 21", etc. | 5" | 1" | 4", 9", 14", etc. |
| 6" | 2" | 4", 10", 16", etc. | 8" | 2" | 6", 14", 22", etc. |

It will be evident that, in the particular case of the horizontal spacing being equal to the vertical spacing, and the desired horizontal margin being equal to the desired vertical margin, then the grid can be considered the same as the example previously described with respect to FIG. 2. As with the previous example, a picture can be used with any compatible grid spacing, including being moved from a first grid to a second grid, and still maintain consistent margins. A picture and a grid are compatible if the picture and the grid are based on the same Spacing and Margin values, and the pegs and sockets fit one another. As also described above, it will be apparent that the grid as a whole can be installed in a rectangular or irregular fashion (such as a triangle or an irregular shape) to accommodate unusual wall spaces such as stairways or alcoves; however each of the spacings between the pegs will still conform to the horizontal and vertical values for spacing as described above.

FIG. 11 is an illustration of a system for hanging multiple pictures in a collage, that uses a modified peg and frame socket in accordance with an embodiment, wherein FIG. 11A shows a front view of the pictures on a grid, while FIG. 11B is an enlarged front view of a peg and a socket, and FIG. 11C is an enlarged section view of the same. As shown in FIG. 11, in accordance with an embodiment, each picture can include a back frame 40 that includes slot-shaped sockets 42. The slot-shaped socket is easier than a completely round socket for the user to locate over a corresponding peg in the grid. The slot can be formed or notched to best accept the bevelled edge, lip, groove, or other features of the peg and ensure the picture is firmly held to the grid.

FIG. 12 is an illustration of a single picture that uses a modified peg and frame socket in accordance with an embodiment, wherein FIG. 12A shows a front view of the picture on a grid, while FIG. 12B is a section view of same, and FIG. 12C is an enlarged section view of the top of the same. As shown in FIG. 12, in accordance with an embodiment, each picture can comprise a back frame on its reverse side, and a picture or photographic print on its obverse side. In accordance with an embodiment the bevelled edges, lip, or other features of the pegs are shaped to better hold the slot-shaped sockets and support both the top edge of the back frame and/or any additional inner slot-shaped sockets.

FIG. 13 is an illustration of various pictures or picture frames that are 1-unit high, and that includes spacers at the bottom, in accordance with an embodiment, wherein FIG. 13A shows a front view of the pictures or picture frames, and FIG. 13C is an enlarged section view of the same. As described above, in some embodiments the user can lets a picture swing into the wall until its bottom edge rests against the wall, or the backside of its photographic print rests against the inner pegs within the boundary of the picture, which allows the picture to hang horizontally level, and substantially flush or parallel to the surface of the wall. In some instances, such as a picture that hangs from a bottom row of pegs in a grid, or a picture that is undersized or too small to cover an inner peg, then the picture might not lie flush against the wall. In accordance with an embodiment, such a picture can include feet or spacers 84 of a length approximately equal to the length of a peg. When the picture is placed on the grid, the spacers ensure that the picture is held flush to or substantially parallel to the wall, together with the other pictures of the collage.

Figure 14:
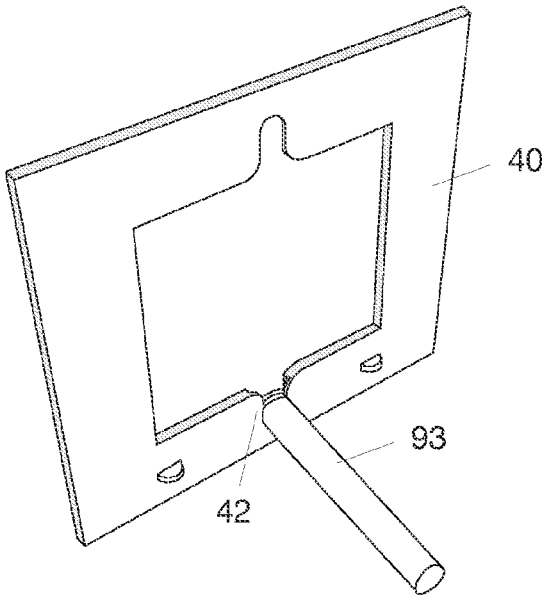
FIG. 14 is an illustration of a single picture or picture frame that accepts a stand so that it can be used as a free-standing picture frame, in accordance with an embodiment.
Figure 15:
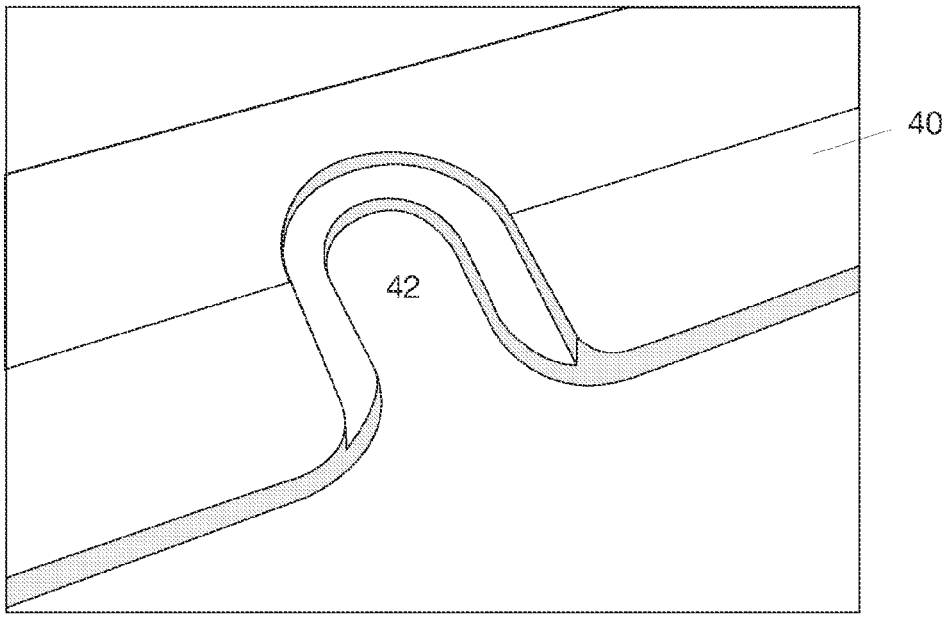
FIG. 15 is an illustration of a socket formed within a picture frame, in accordance with an embodiment.

FIG. 14 is an illustration of a picture or picture frame that accepts a stand so that it can be used as a free-standing picture frame, in accordance with an embodiment. As shown in FIG. 14, an optional stand element 93 can fit into the socket 42 on the back frame 40. When the picture is removed from the collage (perhaps to replace it with a new picture), the removed picture can be used as a free standing picture. Although FIG. 14 shows a 1-unit square picture, it will be evident that other sizes could be similarly displayed, subject to the consideration that a larger picture frame would be less stable and/or require a more substantially-sized or -weighted stand element. Combined with the ability to move a picture from one grid to another grid, the additional ability of some pictures to accept a stand allows a user to update their collage with new pictures, and to make use of any older pictures they may have removed from the collage FIG. 15 is an illustration of a socket formed within a picture frame, in accordance with an embodiment. As shown in FIG. 15, in accordance with an embodiment, each socket is provided in the form of a u-shaped, or v-shaped slot or notch 42. The slot or notch can be formed having an obverse and a reverse side, wherein the obverse side accepts or faces the picture, and the reverse side (shown in FIG. 15) is beveled to better accept the shape of the peg when the frame is placed on the grid. This helps to prevent the frame from slipping forward and off the peg. As further shown in FIG. 15, in accordance with some embodiments, a back frame can be provided without a picture but instead with an adhesive border. A user can remove the adhesive border and adhere a picture or other object to the back frame, which can then be hung on the grid.

Multiple Socket Backing

FIG. 16 is an illustration of a rigid foam or other backing that can be used with a picture or picture frame, for mounting the picture or picture frame within a collage, in accordance with an embodiment, wherein FIG. 16A shows a front view of the rigid foam or other backing, while FIG. 16B is an enlarged front view of a peg and a socket, and FIG. 16C is an enlarged section view of the same. In accordance with some embodiments, such as those that include a substantially larger picture, a whiteboard, or another large art piece or object, a backing/picture holder 86 with many sockets 88, 90 can be used to better attach the picture to the grid. The use of a plurality of connections keeps the picture (whiteboard, or other object) more rigidly attached to the grid. This aids for example, in preventing the picture or whiteboard from bouncing if somebody presses against it, or writes on its surface. In addition, the more connections that are used to support a single picture the less force that is applied to each peg. This allows a grid of many individually small or weak pegs to support quite heavy pictures/boards, with less damage to the walls, and eliminates the need to find a wall stud or use anchors, which a single larger mount might require.

The improved rigidity also helps in installing collages in locations that are prone to vibration, or earthquake. In accordance with an embodiment the socket material can be made of a generally rigid yet malleable foam, in which the lip of each peg slightly compresses or deforms the foam socket edge, to ensure a closer fit once installed. Since the pegs in any grid may diverge slightly from being a perfectly-spaced grid, the use of a backing that is spread over multiple pegs, and that is somewhat malleable, can be used to compensate for any uneven distribution in the grid pegs.

In accordance with an embodiment, the entire backing can be provided as an adhesive backing board which is then adhered to existing picture frames or objects, to allow those objects to be added to the collage.

FIG. 17 is an illustration of individual backing or stick-on sockets that can be used with a picture or any other type of board 96 or object for mounting within a collage, in accordance with an embodiment, wherein FIG. 17A shows a front view of the individual backing or stick-on sockets, while FIG. 17B is an enlarged front view of a peg and a socket, and FIG. 17C is an enlarged section view of the same. As described above, each socket 94 is shaped to accommodate a peg 82. Multiple stick-on sockets can be adhered to existing pictures or other objects to allow those objects to be added to the collage.

FIG. 18 is an illustration of a template that can be used to apply individual backing or stick-on sockets to a picture frame for mounting within a collage, in accordance with an embodiment, wherein FIG. 18A shows the template in a first position, and FIG. 18B shows the template in its final position. As described above, the use of multiple sockets or connection points improves rigidity, attaches the object to the grid more securely, and allows the weight of the object to be more evenly distributed over multiple pegs, which in turn allows the use of heavier objects in the collage. However, to accomplish this properly the stick-on sockets, if used, must be applied in the correct locations. As shown in FIG. 18A, a template 98 can be provided which is first aligned by the user with the edges of the board, picture, or other object. The user removes a liner from the stick-on sockets, places the socket into a matching hole 95 in the template, and presses it to adhere the socket to the object. The process is continued until all (or at least several) of the holes are filled with stick-on sockets. As shown in FIG. 18B, the user then advances to the next position, and continues moving the template and installing sockets until a sufficient number of sockets have been attached to the object, at which point the template can be removed and the object suspended from the grid.

Built-In Tolerance for Grid Imperfections

FIG. 19 is an illustration of a picture or picture frame with multiple sockets and that further includes an oversized inner socket, in accordance with an embodiment. During installation of a grid, it is possible that one or two pegs are installed slightly off-center. Embodiments of the back frame can accommodate this. As described above, in some embodiments, a backing with multiple sockets can be used, in which the backing is made of a generally rigid yet malleable foam, and in which each peg slightly compresses or deforms the foam socket edge to ensure a closer and more rigid fit once installed, which also compensates for any uneven distribution in the grid pegs.

As shown in FIG. 19, in accordance with another embodiment, a back frame or picture can be formed with its middle socket(s) larger than those at the end, so that these middle sockets do not interfere with the sockets at either end. If the middle pegs happen to be installed out-of-alignment, they will still not affect the positioning and levelling of the picture.

Pictures with Alternative Socket Positions

As described above, in accordance with an embodiment each picture includes one or more sockets, generally along one or more of its edges although in some embodiments a picture can include sockets located elsewhere on the picture.

Figure 20:
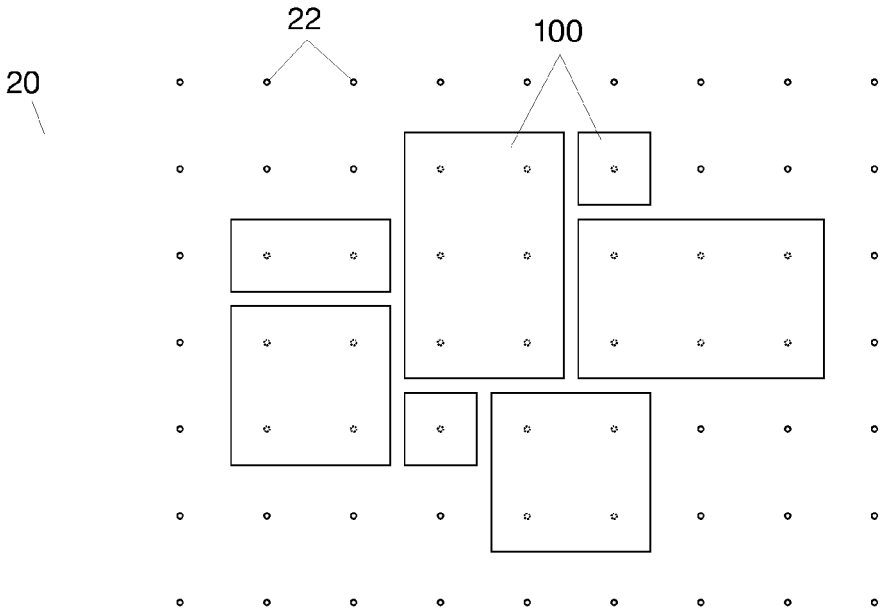
FIG. 20 is an illustration of an embodiment that uses sockets in the middle or in other locations of each picture.

FIG. 20 is an illustration of an embodiment of a collage 100 that uses sockets in the middle or in other locations of each picture. As shown in FIG. 20, pegs can be located within, or in the middle of each picture. An advantage to this approach is that, when a picture is completely removed from the collage to leave blank space, the remaining pegs are located centrally in that blank space, which provides an aesthetic appearance. Since a picture suspended by a single peg at its center would be prone to rotation, in accordance with an embodiment each picture can be supported by two or more pegs, or each peg and socket can be shaped (e.g. square) to prevent rotation about its axis.

Irregular-Shaped Grids

Figure 21:
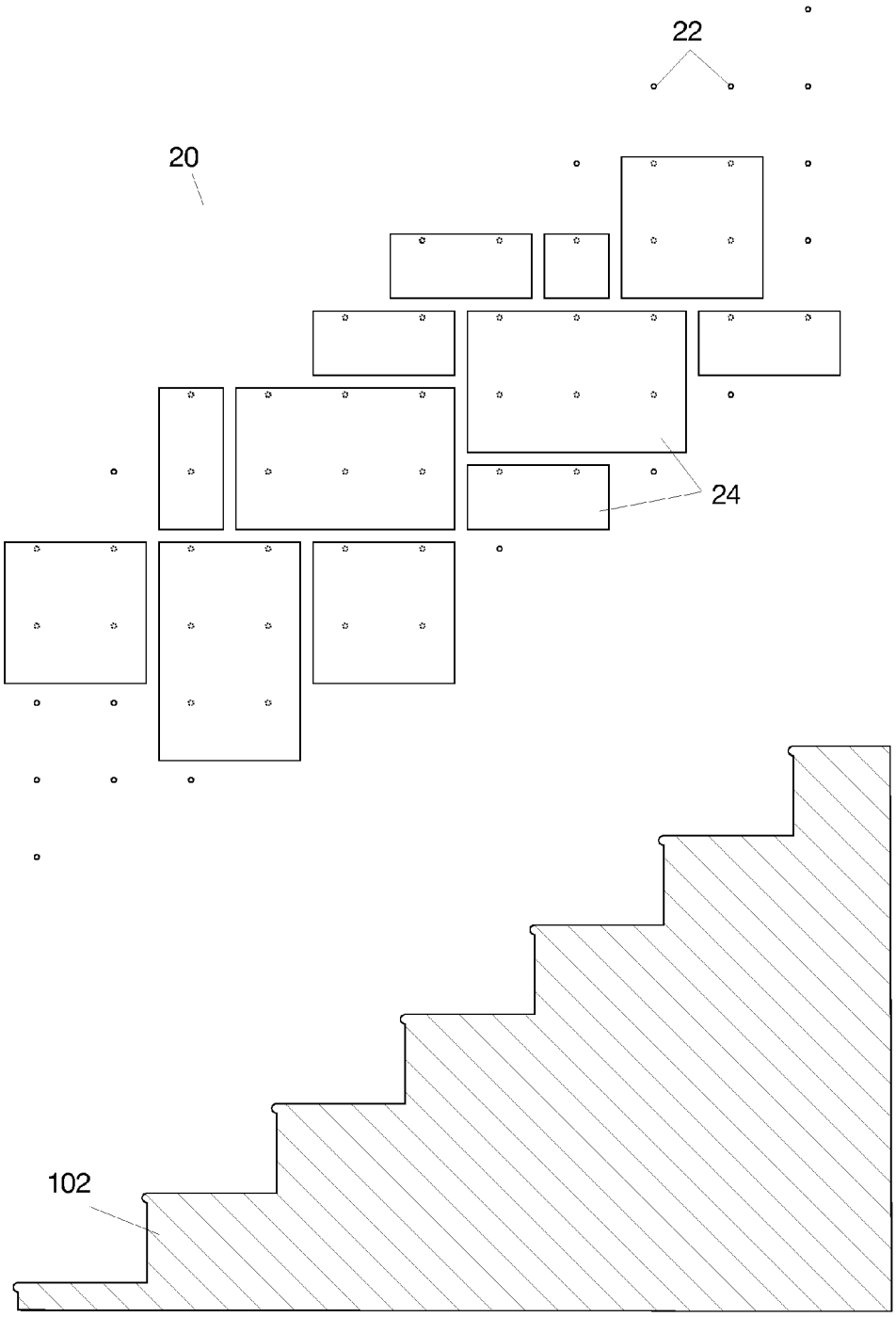
FIG. 21 is an illustration of an embodiment of a grid used in a stair setting.

As described above, a grid as a whole can be installed in a rectangular or irregular shape (such as a triangle or an irregular shape) to accommodate unusual wall spaces such as stairways or alcoves. FIG. 21 is an illustration of an embodiment of a grid used in a stair setting. As shown in FIG. 21, a grid can be installed alongside a staircase 102, or other unusual setting, in an irregular shape but with a consistent horizontal and vertical peg spacing as described previously.

Method of Creating and Modifying Collages

Figure 22:
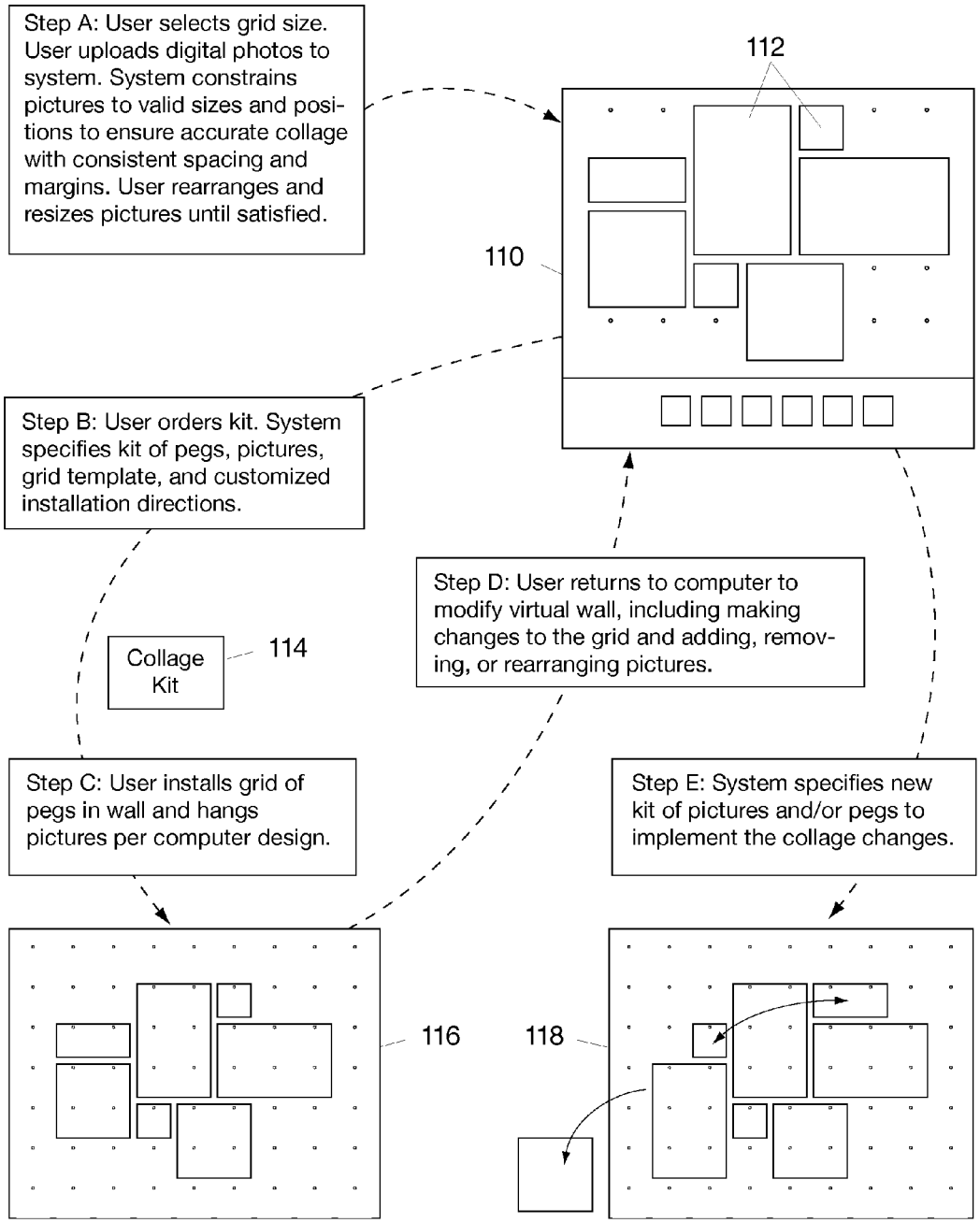
FIG. 22 is an illustration of a system for creating collages in accordance with an embodiment.

FIG. 22 is an illustration of a system for designing and creating collages in accordance with an embodiment. As shown in FIG. 20, in accordance with an embodiment, the user designs an initial collage on their computer, including selecting an initial grid, specifying grid dimensions, and uploading, cropping and rearranging digital pictures on the grid. The user interface 110 can be provided as a stand-alone software application, or as an online or web-based, or other application. The system can automatically configure the collage design 112 for the correct margin and spacing values, and automatically uses these calculations to provide valid picture sizes and heights, and to guide the user through the design process. A kit 114 can then be provided to the user, which includes all of the pieces necessary to create the collage, including pegs, pictures, grid template, and customized installation instructions. The user then uses the kit to install the collage onto their real wall 116 per their collage design. The pictures can be rearranged as desired, including adding and removing pictures, or moving pictures from one grid to another, as described above. At any time, the user can return to the computer interface to modify the collage design, including specifying changes to the grid, and uploading or rearranging new pictures to create a new version of their collage on their real wall 118, and optionally receive any new or additional kit pieces and pictures necessary to create the new collage.

Figure 23:
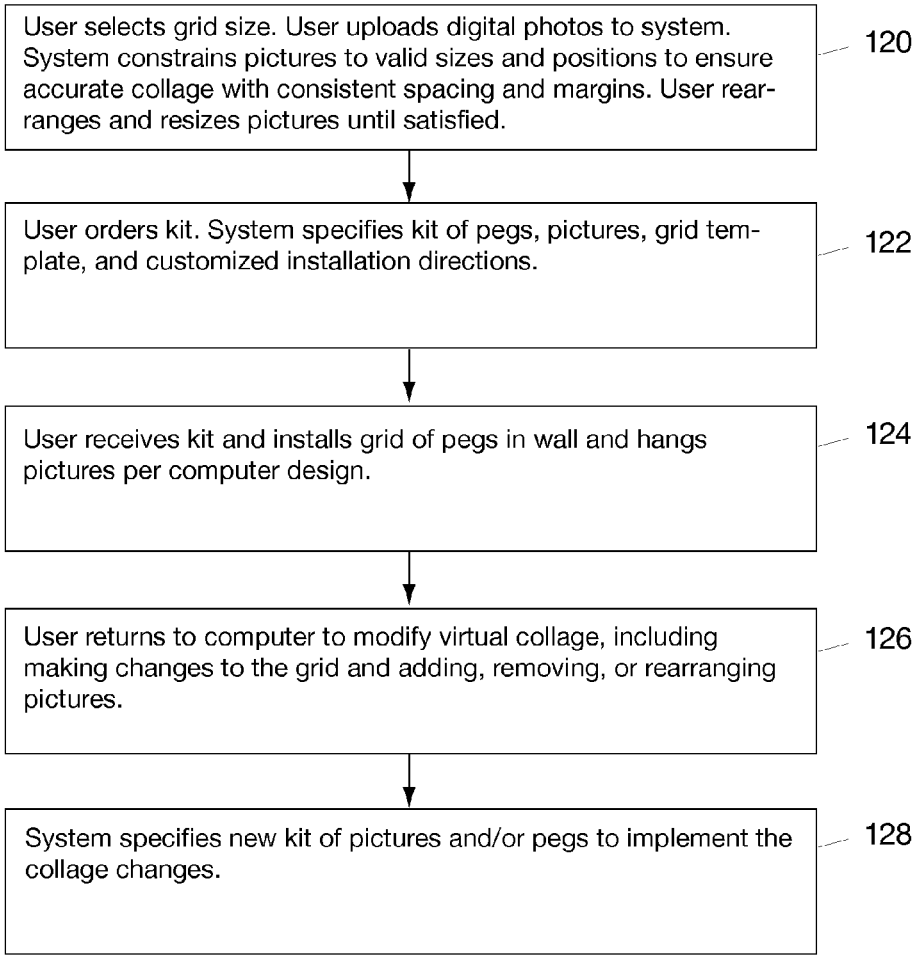
FIG. 23 is a flowchart of a method for designing and creating a collage in accordance with an embodiment.

FIG. 23 is a flowchart of a method for designing and creating a collage in accordance with an embodiment. As shown in FIG. 21, in accordance with an embodiment, in step 120 the user selects a grid size, and uploads their digital pictures to the system. The system can automatically configure the collage design and collage elements for correct margin and spacing values, and positions them within the grid to ensure an accurately displayed collage with consistent spacings and margins. The user can rearrange and resize their pictures until they are satisfied with the appearance of their collage. In step 122, the user orders a kit to install the grid and collage in their home, office or other location. The system automatically specifies a kit including pegs, pictures, grid template, and customized installation instructions. In step 124, the user receives the kit and installs the grid on their wall. They can then hang the pictures to recreate their collage. The pictures can be rearranged as desired, including adding and removing pictures, or moving pictures from one grid to another, as described above. In step 126, the user can return to their computer representation at any time to modify their stored collage, including making changes to their grid, and adding, removing, or rearranging pictures. In step 128, the system automatically determines any new pieces that are needed, and specifies any new kit components, including additional pegs and pictures needed to create the new collage.

Grid Installation Process

FIG. 24 illustrates the process of installing a grid for displaying a collage, in accordance with an embodiment.

Figure 24A:
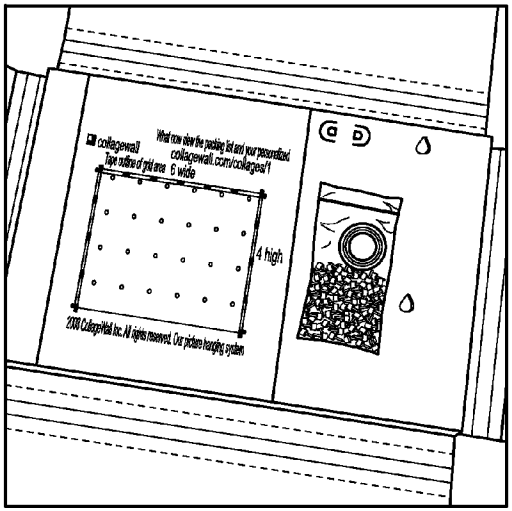
FIG. 24 illustrates the process of installing a grid for displaying a collage, in accordance with an embodiment.

As shown in FIG. 24A, a user first purchases or receives a kit, including a template, pegs, instructions, and a specially-marked tape that assists in the installation process. Depending on the particular needs of each user additional components can be included in the kit, for example a drill bit for specialized wall surfaces, stick-on sockets, or back frames.

Figure 24B:
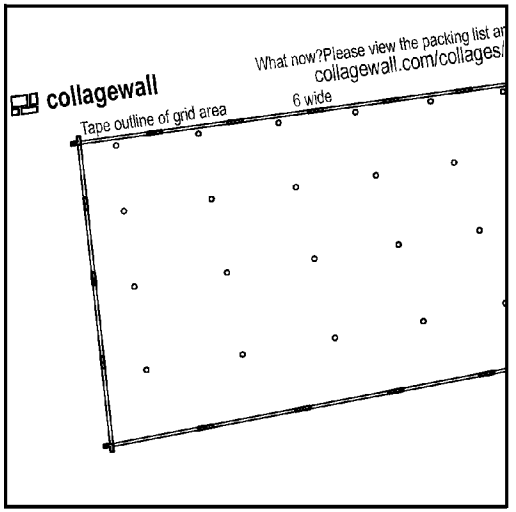

As shown in FIG. 24B, the instructions provided with the kit provide a visual guide to how the grid should look once it is installed on a wall.

Figure 24C:
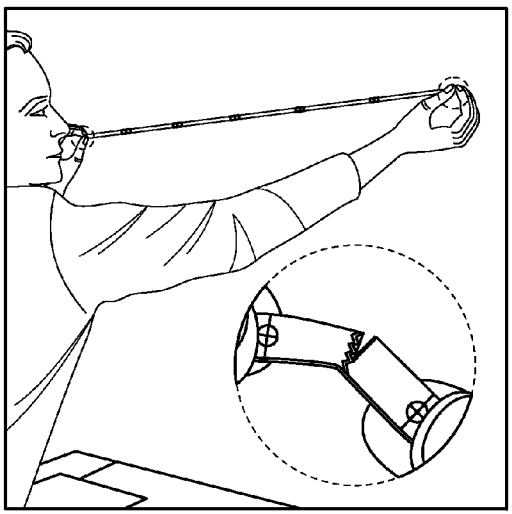

As shown in FIG. 24C, in accordance with an embodiment, the user uses a specially-marked tape to outline on their wall the edge of the grid. In accordance with an embodiment, the tape has tear marks at intervals that match the desired peg spacing to ensure the user selects a valid edge length.

Figure 24D:
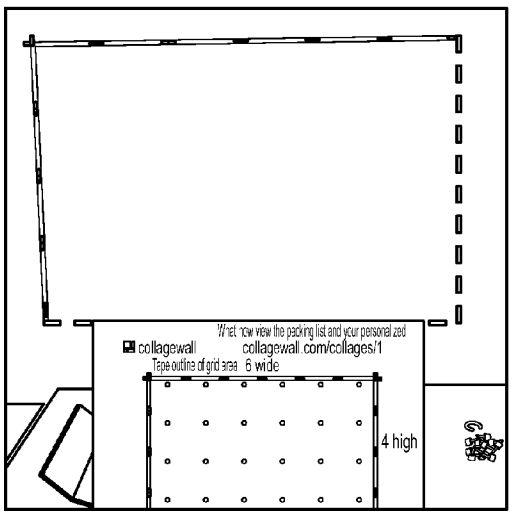

As shown in FIG. 24D, the user can verify the marked-out outline of the grid on the wall, with the representation of the grid in their instructions, to verify that everything is proceeding correctly. The user can move the tape around on the wall to make adjustments to the final position of the grid, before making any permanent changes to the wall.

Figure 24F:
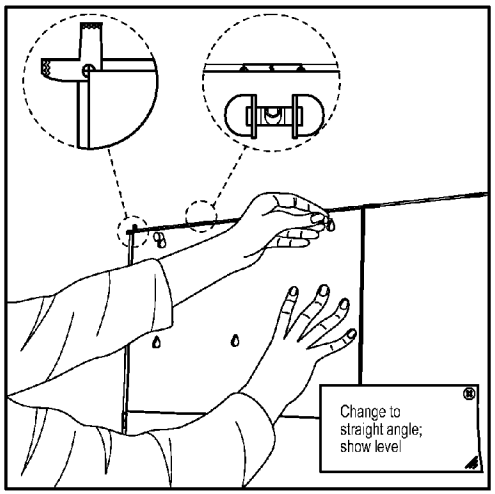
Figure 24H:
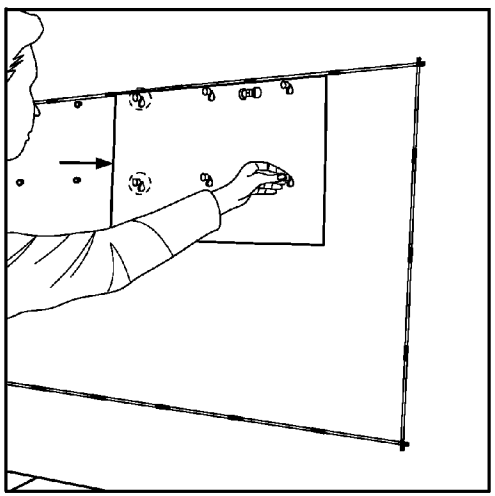
Figure 24E:
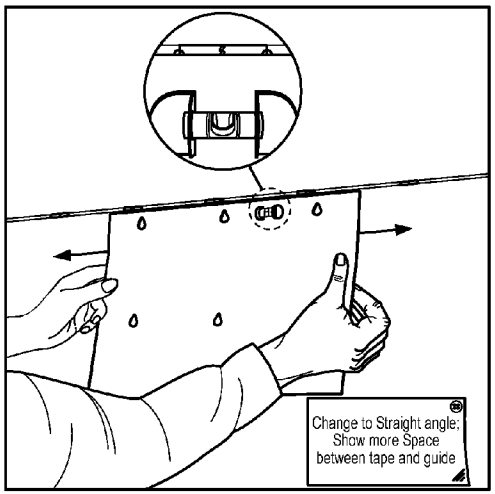

As shown in FIG. 24E a template together with a spirit level can be used to ensure that the top edge of the tape outline is level.

As shown in FIG. 24F, the user can align the template in the upper left corner of the grid outline and use the level to again ensure the template is level. The user can now precisely position and insert the pegs using the templates guide holes.

Figure 24G:
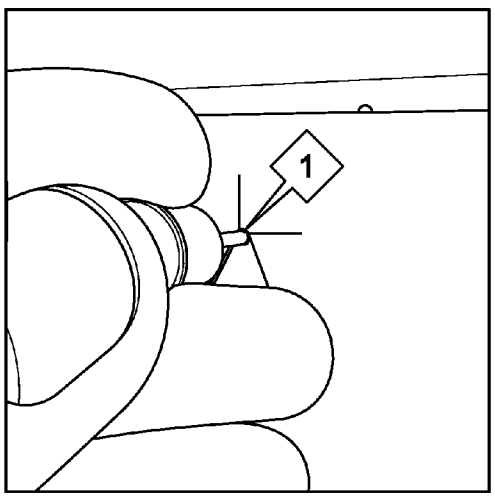

As shown in FIG. 24G, a first peg can then be installed through the template and into the wall. In accordance with an embodiment the pegs can be simply pushed or inserted into many wall surfaces, such as drywall. Each peg should preferably be installed squarely into the wall, not at an angle, since pegs that are angled to a large degree may not hold the picture securely, or may hinder the pictures being installed in a consistent manner.

Figure 24J:
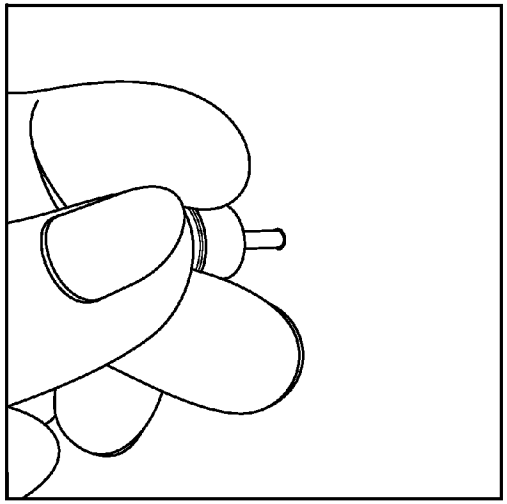
Figure 24I:
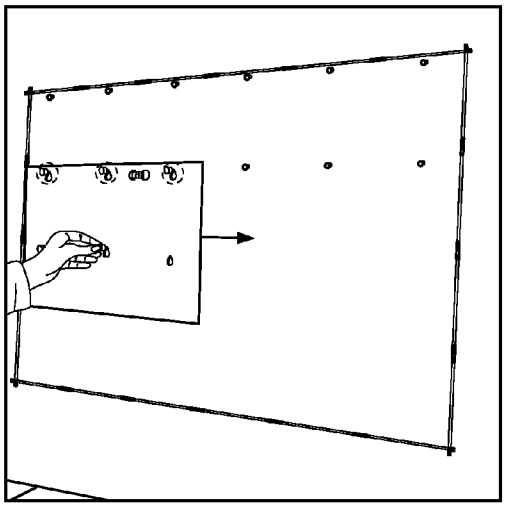

As shown in FIG. 24H-24J, the user moves the template right so that it overlaps two pegs in the wall already. The user fills the empty guide holes with pegs. The user continues to install pegs, using the template to ensure that each peg is place in the proper alignment within the grid. When, as shown in FIG. 24I, a complete row of pegs is installed, the template is suspended from that row, and subsequent rows installed using the same procedure, until all of the pegs that comprise the grid have been installed.

Figure 24L:
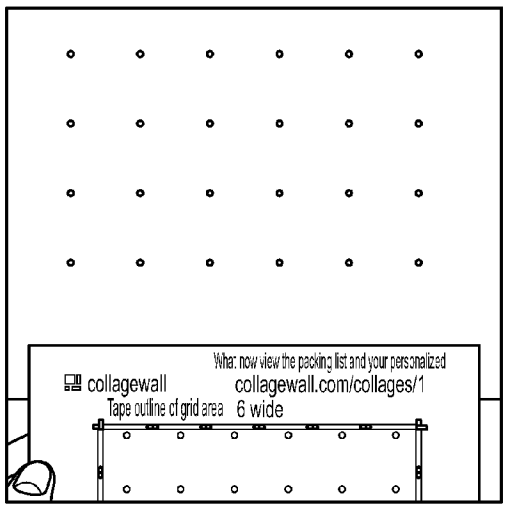
Figure 24K:
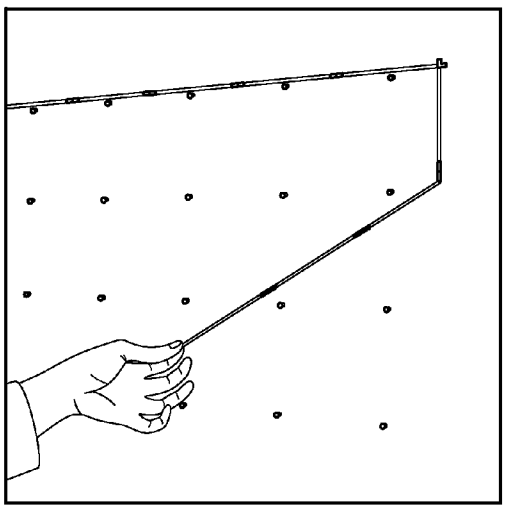

As shown in FIG. 24K, the tape can then be removed from the wall. As shown in FIG. 24L, the grid will have been installed on the wall and will match that represented in the instructions, ready for hanging the pictures.

Computer-Based Collage Designer

FIG. 25 is a series of screenshots of a user interface for creating a collage in accordance with an embodiment.

Figure 25A:
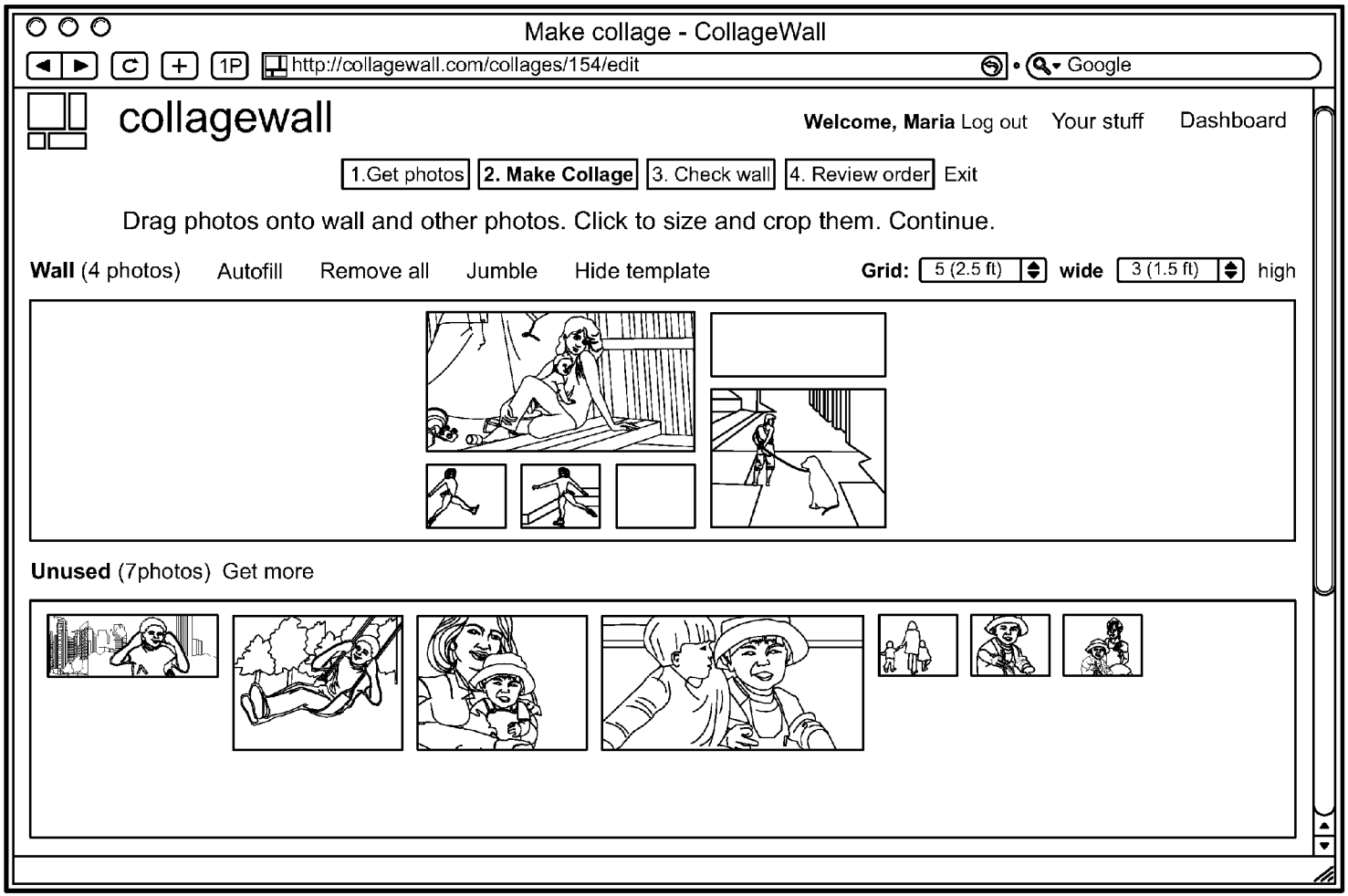
FIG. 25 is a series of screenshots of a user interface for creating a collage in accordance with an embodiment.

As shown in FIG. 25A, in accordance with an embodiment, the system includes a computer software that provides a user interface and allows a user to create a new collage, or modify an existing collage. The user can upload pictures for use in the collage. After the user has selected a collage size and/or type, the system displays a computerized representation of the grid, including the pegs that will be used therein.

Figure 25B:
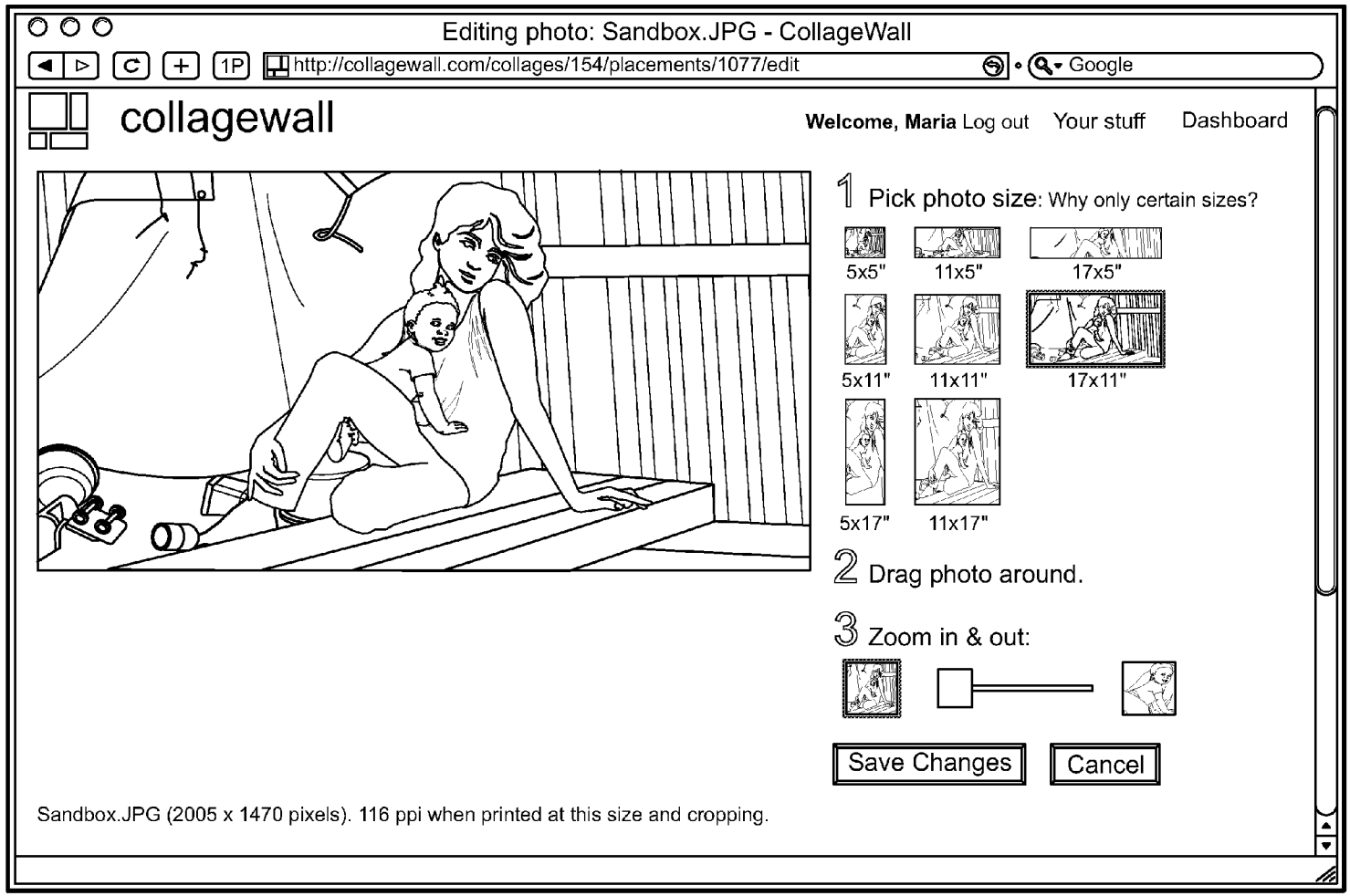

As shown in FIG. 25B, the system allows the user to upload, display, move, and generally experiment with pictures on the grid, to create a virtual collage. While the pictures are being uploaded, prepared, and arranged on the grid, the system takes into account the center-to-center spacing between the pegs, and the desired margin between the pictures, and then automatically determines the valid height and width values for each picture so that when the picture is placed on the grid with other pictures, each of the pictures will form a collage in which the edges of each picture align both horizontally and vertically, i.e. that there is a consistent margin between the pictures. When the user is satisfied with the virtual collage, they can configure their wall-mounted collage to match the computerized representation, with the assurance that the wall-mounted version will match the computerized representation. The system can provide further assistance in this regard, including providing suggestions to the user, and automatically including in the installation kit any components that are particularly needed by this user to install their grid and collage.

Optional Features and Uses

Instead of the pegs being round, they can be any shape (e.g. flat, square, wedge), and small pictures hung by just one peg-socket connection can be kept level by various non-round peg-socket connections (e.g. a square peg on a square socket).

Other connective devices can be substituted for the peg-socket connection (e.g. hooks, snaps, magnets, fabric hook-and-loop fasteners, adhesives).

Supports can be attached to the wall by various means (e.g. adhesive, nail, screw).

Supports and frames can be composed of various materials (e.g. wood, aluminum, plastic).

Instead of being mounted on a traditional wall, the pegs can be mounted on any vertical or near-vertical planar surface, such as a window, a suspended or free-standing surface, a flat surface mounted on a wall.

Instead of using the 6" spacing and 1" margin values shown in figures, the hanging system can use any spacing and margin values.

Instead of being easily-removable, pictures can be locked to the grid by adding a locking mechanism to the peg-socket connection.

The grid of pegs can be wired with electricity to supply power or control signals to various supported items, such as low-voltage lights, computers, and displays.

The foregoing description of the present invention has been provided for the purposes of illustration and description. It is not intended to be exhaustive or to limit the invention to the precise forms disclosed. Many modifications and variations will be apparent to the practitioner skilled in the art. Particularly, it will be evident that additional peg types and means of affixing to walls and other surface can be used. For example, the face of each peg or support, and of each socket, can be of any shape other than the round or square examples described above. It will also be evident that other techniques of installing the grid can be used within the spirit and scope of the invention. In accordance with different embodiment, the pictures can include one or more of photos, stretched-canvas pictures, artwork, shadow boxes, whiteboards, chalkboards, mirrors, clocks, calendars, brochure holders, flat-screen computer displays, or other objects that a user may place within their collage. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A system that allows a collage of pictures to be displayed on a wall, comprising:

a plurality of pegs affixed to or inserted into a wall or other surface, as a pattern of horizontal rows and vertical columns having a regular horizontal peg separation and regular vertical peg separation from one another, to form a grid of the peas distributed across the wall or other surface;

a plurality of picture holders, wherein each picture holder is sized to fit within the grid, and includes an obverse surface and a reverse surface, and further wherein the obverse surface of each picture holder includes, or can receive, a photo or other picture for display within or as part of a collage, the reverse surface of each picture holder includes one or more sockets distributed across its surface, or as a backing, to secure the picture holder within the grid, including wherein when the sockets are spaced to match the regular horizontal peg separation and regular vertical peg separation of the pegs in the grid, and the width and height dimensions of each picture holder are sized to enable that picture holder to be accommodated within or as part of the collage, including when that picture holder is secured within the grid providing consistent horizontal and vertical margins between that picture holder, and photo or picture associated therewith, and other pictures displayed on the grid within or as part of the collage; and wherein the plurality of picture holders, and photos or pictures associated therewith, can be arranged on areas of the grid to create the collage, and wherein when a first picture holder is placed on a first area of the grid, its one or more sockets receive compatible pegs in the grid that support the first picture holder, and photo or picture associated therewith, within or as part of the collage, leaving other areas of the grid and pegs available for use by additional picture holders, and wherein the plurality of picture holders can be subsequently rearranged on the grid to form different collages.

2. The system of claim 1, wherein each picture holder that is sized to be accommodated within or as part of the collage has, as particular dimensions, a photo or picture width that is a multiple of the horizontal peg separation less the horizontal margin, and a photo or picture height that is a multiple of the vertical peg separation less the vertical margin.

3. The system of claim 1, wherein each peg extends outward from the wall to allow the picture holders to be suspended therefrom.

4. The system of claim 1, wherein the regular horizontal peg separation is equal to the regular vertical peg separation, and the horizontal margin is equal to the vertical margin.

5. The system of claim 1, wherein the regular horizontal peg separation is different from the regular vertical peg separation, and wherein the horizontal margin is different from the vertical margin, and wherein each picture holder that is sized to be accommodated within or as part of the collage has, as particular dimensions, a photo or picture width that is a multiple of the horizontal peg separation less the horizontal margin, and a photo or picture height that is a multiple of the vertical peg separation less the vertical margin.

6. The system of claim 1, wherein each of the pegs are beveled, have one of a lip or a groove, or are otherwise shaped to be compatible with the shape of the sockets, so that when a picture holder is suspended on the grid using the pegs, the shape of the pegs bias and/or hold the picture holder and its photo or picture associated therewith to lie generally close and flush with or parallel to the wall or other surface.

7. The system of claim 1, wherein each of the picture holders includes at least two sockets distributed across its reverse surface or backing, that mate with at least two compatible pegs, to ensure that the picture holder is held in a horizontal manner on the grid.

8. The system of claim 1, wherein at least some of the picture holders includes sockets distributed across its reverse surface in both vertical and horizontal directions or along at least two edges of its reverse surface, to allow the picture holder to be positioned on the grid in a plurality of different orientations.

9. The system of claim 1, wherein some or all of the picture holders are sized to extend in at least one dimension beyond the regular horizontal or vertical peg separation distance of the pegs in the grid, and wherein those picture holders include cutouts, voids, or additional sockets distributed across their reverse surface or backing that can accommodate pegs within those cutouts, voids, or additional sockets, and so that when the picture holder is placed on the grid it can remain generally close and flush with or parallel to the wall or other surface.

10. The system of claim 1, wherein each picture holder includes one or more adhesive sockets distributed over its obverse surface.

11. The system of claim 1, wherein the grid can be installed on a vertical or near-vertical planar surface, including one of a wall, window, other suspended or free-standing surface, or flat interim backer board mounted on the wall.

12. The system of claim 1, wherein each of the pegs can have a round, square or other shaped face.

13. The system of claim 1, wherein those picture holders which reverse surface includes one or more sockets as a backing include that the backing is made of a generally rigid yet malleable foam, card, or other material with multiple sockets distributed thereon.

14. The system of claim 1, wherein the grid is wired with electricity to supply power or control signals to various supported items, such as low-voltage lights, computers, and displays.

15. The system of claim 1, wherein the grid comprises wider support rails as pegs, and wherein each picture holder includes a groove along an inside top edge to one of receive or grasp the support rails.

16. The system of claim 1, wherein one or more picture holders include a locking mechanism to lock the picture holder to the peg from which it is supported.

17. The system of claim 1, wherein the system further comprises a template for assisting in initially installing the grid of pegs on the wall or other surface, including indications for the regular horizontal peg separation and the regular vertical peg separation.

18. A method for displaying a collage of pictures, comprising the steps of:

providing a plurality of pegs affixed to or inserted into a wall or other surface, as a pattern of horizontal rows and vertical columns having a regular horizontal peg separation and regular vertical peg separation from one another, to form a grid of the pegs distributed across the wall or other surface;

providing a plurality of picture holders, wherein each picture holder is sized to fit within the grid, and includes an obverse surface and a reverse surface, and further wherein the obverse surface of each picture holder includes, or can receive, a photo or other picture for display within or as part of a collage, the reverse surface of each picture holder includes one or more sockets distributed across its surface, or as a backing, to secure the picture holder within the grid, including wherein when the sockets are spaced to match the regular horizontal peg separation and regular vertical peg separation of the pegs in the grid, and the width and height dimensions of each picture holder are sized to enable that picture holder to be accommodated within or as part of the collage, including when that picture holder is secured within the grid providing consistent horizontal and vertical margins between that picture holder, and photo or picture associated therewith, and other pictures displayed on the grid within or as part of the collage; and wherein the plurality of picture holders, and photos or pictures associated therewith, can be arranged on areas of the grid to create the collage, and wherein when a first picture holder is placed on a first area of the grid, its one or more sockets receive compatible pegs in the grid that support the first picture holder, and photo or picture associated therewith, within or as part of the collage, leaving other areas of the grid and pegs available for use by additional picture holders, and wherein the plurality of picture holders can be subsequently rearranged on the grid to form different collages.

19. A system for use in displaying a collage of pictures, comprising:

a plurality of pegs affixed to or inserted into a wall or other surface, as a pattern of horizontal rows and vertical columns having a regular peg separation from one another, to form a grid of the pegs distributed across the wall or other surface;

a plurality of picture holders, wherein each picture holder is sized to fit within the grid, and includes an obverse surface and a reverse surface, and further wherein the obverse surface of each picture holder includes, or can receive, a photo or other picture for display within or as part of a collage, the reverse surface of each picture holder includes one or more sockets distributed across its surface, or as a backing, to secure the picture holder within the grid, including wherein when the sockets are spaced to match the regular peg separation of the pegs in the grid;

wherein the width and height dimensions of each picture holder are sized to enable that picture holder to be accommodated within or as part of the collage, including when that picture holder is secured within the grid providing consistent horizontal and vertical margins between that picture holder, and photo or picture associated therewith, and other pictures displayed on the grid within or as part of the collage; and wherein the plurality of picture holders, and photos or pictures associated therewith, can be arranged on areas of the grid to create the collage, and wherein when a first picture holder is placed on a first area of the grid, its one or more sockets receive compatible pegs in the grid that support the first picture holder, and photo or picture associated therewith, within or as part of the collage, leaving other areas of the grid and pegs available for use by additional picture holders, and wherein the plurality of picture holders can be subsequently rearranged on the grid to form different collages.

* * * * *